US005852453A

United States Patent [19]

Hirahara et al.

[11] Patent Number: 5,852,453

[45] Date of Patent: Dec. 22, 1998

[54] INK-JET PRINTER

[75] Inventors: Shuzo Hirahara, Yokohama; Hitoshi Nagato, Tokyo; Yuko Nomura; Koichi Ishii, both of Kawasaki; Yasuo Hosaka, Tokyo; Hideyuki Nakao, Kawasaki; Teruo Murakami, Yokohama, all of Japan

[73] Assignee: Kabushiki Kaisha Toshiba, Kawasaki, Japan

[21] Appl. No.: 610,398

[22] Filed: Mar. 4, 1996

[30] Foreign Application Priority Data

Mar. 15, 1995 [JP] Japan ..... 7-056219

[51] Int. Cl.[6] ..... B41J 2/065

[52] U.S. Cl. ..... 347/55

[58] Field of Search ..... 347/5, 6, 7, 8, 347/9, 54, 55

[56] References Cited

U.S. PATENT DOCUMENTS

| | | | |
|---|---|---|---|
| 4,710,784 | 12/1987 | Nakayama | 347/15 |
| 4,929,968 | 5/1990 | Ishikawa | 347/55 |
| 5,539,440 | 7/1996 | Higuchi et al. | 347/112 |
| 5,619,234 | 4/1997 | Nagato et al. | 347/55 |

FOREIGN PATENT DOCUMENTS

| | | |
|---|---|---|
| 49-62024 | 6/1974 | Japan . |
| 53-12138 | 4/1978 | Japan . |
| 56-4467 | 1/1981 | Japan . |
| 56-9429 | 3/1981 | Japan . |
| 61-59911 | 12/1986 | Japan . |

*Primary Examiner*—Matthew Nguyen
*Attorney, Agent, or Firm*—Oblon, Spivak, McClelland, Maier & Neustadt, P.C.

[57] ABSTRACT

An auxiliary substrate is provided so as to face a main substrate to which ink is supplied and the pattern of a voltage applied to an auxiliary electrode array formed on the auxiliary substrate is controlled. In a printing operation, the coloring material components are sent to the vicinity of an ink droplet emitting outlet and the coloring material components in the ink where the coloring material is dispersed in solvent are concentrated. Then, they are emitted from the ink droplet emitting outlet in the form of ink droplets and are forced to fly at a printing medium, thereby printing on the medium. In a non-printing operation, the auxiliary electrode array is controlled so that the coloring material components may be kept away from the ink droplet emitting outlet and the concentration of the coloring material components in the ink near the ink droplet emitting outlet is made lower than in a printing operation.

13 Claims, 16 Drawing Sheets

INK-JET PRINTER

BACKGROUND OF THE INVENTION

1.Field of the Invention

This invention relates to an ink-jet printer, and more particularly to an ink-jet printer that uses liquid ink in which charged coloring material is allowed to float in an insulating solvent, concentrates the coloring material component in the ink, and forces the ink to fly at a printing medium.

2.Description of the Related Art

A printing apparatus that forms liquid ink into small liquid drops called ink droplets and forces them to fly at a printing medium, thereby forming printing dots to print an image (including characters), is known as an ink-jet printer, which has been put to practical use. The ink-jet printer is more silent than other printing methods, has the advantage of requiring neither development nor fixing, and has been attracting attention from the viewpoint of paper printing technology. A lot of ink-jet printer methods have been proposed. Typical ones of them are: (1) a method of using steam pressure caused by the heat of a heating element to force ink droplets to fly (e.g., Jpn. Pat. Appln. KOKOKU Publication No. 56-9429, filed by Makoto Obu of Ricoh Co., Ltd. or Jpn. Pat. Appln. KOKOKU 61 -59911, filed by Ichiro Endo, et al. of Canon Inc.) and (2) a method of using mechanical pressure pulses generated by a piezoelectric element to force ink droplets to fly (e.g., Jpn. Pat. Appln. KOKOKU Publication No. 53-12138, filed by Edmond L. Kyser, et al. of Silonix Incorporated). Both of these methods use pressure pulses and are of the multi-nozzle type that prints multiple dots in parallel.

A serial scanning head that is mounted on a carriage and prints while moving in the direction (main scanning direction) perpendicular to the printing paper transport direction (feed direction) has been used as a printing head used in an ink-jet printer. Since the serial scanning head prints while moving mechanically, it is difficult to increase the printing speed. To overcome the shortcoming, a line scanning head that uses a line head as long as the width of printing paper as a printing head has been proposed. With this head, the number of mechanical moving parts decreases and the printing speed increases. To realize such a line scanning head is not easy for the following reasons.

First, the ink-jet printing method is essentially liable to develop a local concentration of ink because of evaporation or volatilization of solvent, which contributes to the clogging of individual thin nozzles corresponding to the resolution. Accordingly, with a method of using steam pressure to form an ink jet, the adhesion of insolubles due to thermal or chemical reaction with ink makes the clogging more liable to develop. Additionally, with a method of using pressure caused by a piezoelectric element to form an ink jet, the complex construction of the ink passage makes the clogging more liable to develop. A serial scanning head using several tens to a hundred and several tens of nozzles is designed to suppress the frequency of clogging to a low level. In the case of a line scanning head requiring as many nozzles as several thousands, however, there is a probability that the clogging of nozzles may take place at a rather high frequency, causing a serious problem in terms of reliability.

Furthermore, another problem is that conventional ink-jet printers are not suitable for improvements in the resolution. Specifically, with the method of using steam pressure, it is difficult to form ink particles whose diameter is 20 $\mu$m or less (which correspond to printing dots whose diameter is the fifties of $\mu$m on printing paper). In addition, with the method of using pressure caused by a piezoelectric element, since the printing head is of a complex structure, it is difficult to form a head with high resolution on account of manufacturing techniques.

To overcome these drawbacks, an ink-jet printing method of applying an voltage to a thin-film electrode array and using electrostatic force to force the ink or the coloring material component in the ink to fly from the ink surface has been considered. Specifically, a method of using electrostatic attraction to force the ink to fly (e.g., Jpn. Pat. Appln. KOKAI Publication 49-62024, filed by the assignee of the present invention or Jpn. Pat. Appln. KOKAI Publication 56-4467, filed by Susumu Ichinose of Nippon Telegraph and Telephone Public Corp.) and a method of using ink containing charged coloring material components, increasing the concentration of the coloring materials, and forcing the ink to fly (e.g., WO93/11866: PCT/AU92/00665) have been proposed. With these methods, the configuration of the printing head is either a slit-like nozzle structure as shown in FIG. 1 that does not require a separate nozzle for each dot, or a nozzleless structure as shown in FIG. 2 that does not need the partitions of an ink passage for each dot. Here, reference numeral 1 indicates an electrode array, 2 a main substrate, 3 ink passages, and 4 ink droplet emitting point. Such structures help prevent and remedy the clogging of nozzles, which has been a serious hindrance in realizing a line scanning printing head. Since the nozzleless structure can generate ink droplets with a very small diameter stably and force the ink to fly, it is suitable for high-resolution design.

The conventional methods of FIGS. 1 and 2, however, have the following disadvantages.

First, with these conventional methods, a thin film of concentrated ink 5 must be applied onto the electrode array 1 composed of a plurality of electrodes corresponding to pixels. Accordingly, as shown in FIG. 2, a coloring material 7 is precipitated as a result of evaporation of the solvent of the ink 5, with the result that the coloring material 7 adheres to the electrode array 1 or fine dust floating in the air stick to the array. This may change the direction in which an ink droplet flies, as shown by reference numeral 7 of FIG. 2. When such a state change has taken place particularly at an ink droplet emitting point on the electrode array 1, the ink flying characteristic changes as follows: not only the flying direction of an ink droplet but also the diameter of a flying ink droplet vary, the flying start time becomes unstable, or the ink droplets stop flying.

Furthermore, to maintain the proper printing operation of the apparatus, the surface of the electrode array 1 must be always kept wet with the ink. When the apparatus is operating continuously, the ink continues circulating and flows without remaining at the tip of the electrode array 1. When the printing operation has stopped for a relatively long time or when the power switch is turned off for a relatively long time, the ink stops circulating and the flow of the ink at the tip of the electrode array 1 ceases. As a result, as shown by reference symbol 8 of FIG. 2, a portion where the ink 5 dries at the ink droplet emitting point on the electrode array 1 may develop. Should this happen, ink droplets would not fly from the dried electrode array 1.

Still further, the method of using nozzles that have no separate partition for each dot but slit-like openings has fewer structural materials to hold the ink by viscous friction or surface tension than the method of using nozzles that have a separate partition for each dot. This causes the problem that when the apparatus undergoes a physical impact, the ink is liable to flood.

SUMMARY OF THE INVENTION

An object of the present invention is to provide an ink-jet printer which maintains the necessary ink thin layer on electrodes for printing and prevents the fixing of coloring materials, the adhesion of dust in the air, and the drying of solvent, which all affect the flying characteristic of ink droplets.

A second object of the present invention is to provide an ink-jet printer which maintains the ink thin layer, eliminates factors that have an adverse effect on the ink droplet flying characteristic, and is less liable to leak the ink even if suffering a physical impact.

According to a first aspect of the present invention, there is provided an ink-jet printer comprising: ink in which charged coloring material components are floating in solvent; printing means for forcing the coloring material components to fly in the form of ink droplets from an emitting outlet at a printing medium and thereby printing a desired image; and control means for controlling the concentration of the coloring material components in the ink in the vicinity of the emitting outlet so that the concentration may be lower in a non-printing operation than in a printing operation.

Here, a non-printing operation includes not only an out-of-operation period during which the printing apparatus is not used, but also a period during which actual printing is not done, such as the interval between the time immediately after the power of the printing apparatus has been turned on and the time immediately before actual printing is started.

Furthermore, an auxiliary substrate is provided so as to face a main substrate to which ink where coloring material components are dispersed in solvent is supplied. On the auxiliary substrate, an auxiliary electrode array is formed which transports the coloring material components supplied onto the main substrate to the vicinity of the ink droplet emitting outlet in a printing operation and keeps the coloring material components away from the ink droplet emitting outlet in the non-printing operation. Specifically, a voltage is applied to the auxiliary electrode array so as to convey the charged coloring material components to the vicinity of the ink droplet emitting outlet in the printing operation, and keep them away from the ink droplet emitting outlet in the non-printing operation.

Furthermore, a main electrode array is arranged on the main substrate. To the main electrode array, a voltage to concentrate the charged coloring material components in the ink supplied onto the main substrate and move them toward the auxiliary substrate side and a voltage to force the coloring material components to fly at a printing medium in the form of ink droplets are applied.

The ink droplet emitting outlet is preferably formed on the auxiliary substrate. In the ink supplied onto the main substrate, the coloring material components charged by application of a bias voltage to the main electrode array are transported to the vicinity of the ink droplet emitting outlet, and then are emitted from the ink droplet emitting outlet in the form of ink droplets by application of a printing signal voltage to the main electrode array. The emitted ink droplets fly in the direction almost perpendicular to the face of the substrate and arrive at the printing medium. In another embodiment, the ink droplet emitting outlet may be formed at the ends of the main substrate and auxiliary substrate and ink droplets may be emitted from the ends toward the side of the substrate.

The main electrode array on the main substrate and the auxiliary electrode array on the auxiliary substrate are arranged to form a stripe pattern so that they may cross at right angles with each other. In this case, it is desirable that the main electrode array should be arranged in a staggered fashion so as to extend from both sides toward the slit-like ink droplet emitting outlet formed on the auxiliary substrate.

In the ink-jet printer constructed as described above that concentrates the coloring material components in the ink by electrostatic force, emits the ink from the ink droplet emitting outlet and forces the ink to fly at a printing medium, thereby printing on the medium, the precipitation of coloring material components near the ink droplet emitting outlet open to the outside in a non-printing operation, the adhesion of coloring material components to the outlet, and the drying of the electrode surface near the ink droplet emitting outlet can be prevented by sufficiently increasing the concentration of the coloring material components in the ink near the ink droplet emitting outlet in a printing operation to such an extent that printing can be done and making the concentration sufficiently lower in a non-printing operation than in a printing operation. This enables the stable printing operation to be maintained for a long time without the change of the ink droplet flying characteristic with time.

Furthermore, with the present invention, concentration control of the coloring material components in the ink near the ink droplet emitting outlet can be realized easily by controlling the pattern of a voltage applied to the electrode array on the auxiliary substrate provided so as to face the main substrate to which the ink is supplied. Specifically, for example, when a multi-phase pulse voltage subjected to phase-shift control so that the voltage applying position may move along the array as time passes is applied to the auxiliary electrode array, the charged coloring material components concentrated by application of voltage to the main electrode array and moved to the auxiliary substrate side advance by migration in the direction according to the pattern of a multi-phase voltage applied to the auxiliary electrode array. Thus, by moving the concentrated coloring material components needed for printing to the vicinity of the ink droplet emitting outlet in the printing operation and moving the coloring material components away from the ink droplet emitting outlet in the non-printing operation, the concentration of the coloring material components in the ink near the ink droplet emitting outlet becomes higher in the printing operation and lower in the non-printing operation.

According to a second aspect of the present invention, there is provided an ink-jet printer comprising: ink in which charged coloring material components are floating in solvent; printing means for forcing the coloring material components to fly in the form of ink droplets from an emitting outlet at a printing medium and thereby printing a desired image; and film thickness control means for controlling the film thickness of the ink in the vicinity of the emitting outlet so that the film thickness may be thinner in a printing operation and thicker in a non-printing operation.

With the present invention, the thickness (film thickness) of the ink near the ink droplet emitting outlet is controlled so as to be thinned sufficiently in the printing operation to such an extent that ink droplets can be emitted easily, concretely as thin as 30$\mu$m or less. In the non-printing operation, the thickness of the ink is controlled to be sufficiently thicker than in the printing operation, concretely, as thick as 100 $\mu$m or more. Controlling the thickness this way prevents the precipitation of coloring material components near the ink droplet emitting outlet open to the outside in a non-printing operation, the adhesion of coloring material components to the outlet, and the drying of the electrode surface near the ink droplet emitting outlet, with the result that the stable ink droplet flying characteristic can be maintained for a long time.

Furthermore, by providing an ink droplet emitting outlet as an opening in the auxiliary substrate and emitting ink droplets in the direction almost perpendicular to the face of the substrate, the ink can be prevented from flooding and spilling from the emitting outlet, when a high pressure is applied to the ink to wet the electrode surface or when an unexpected physical impact is exerted on the ink during operation. Additionally, by forming an ink droplet emitting outlet provided in the auxiliary substrate into a slit form and arranging the main electrode array on the main substrate in a staggered fashion so that the array may extend from both sides toward the slit-like ink droplet emitting outlet, printing can be done with a high resolution twice the arrangement pitch of the main electrode array on both sides of the slit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Hereinafter, referring to the accompanying drawings, ink-jet printers according to first to sixth embodiments of the present invention will be explained.

First, an ink-jet printer according to a first embodiment of the present invention will be described with reference to FIGS. 3 to 6B.

Figure 1:
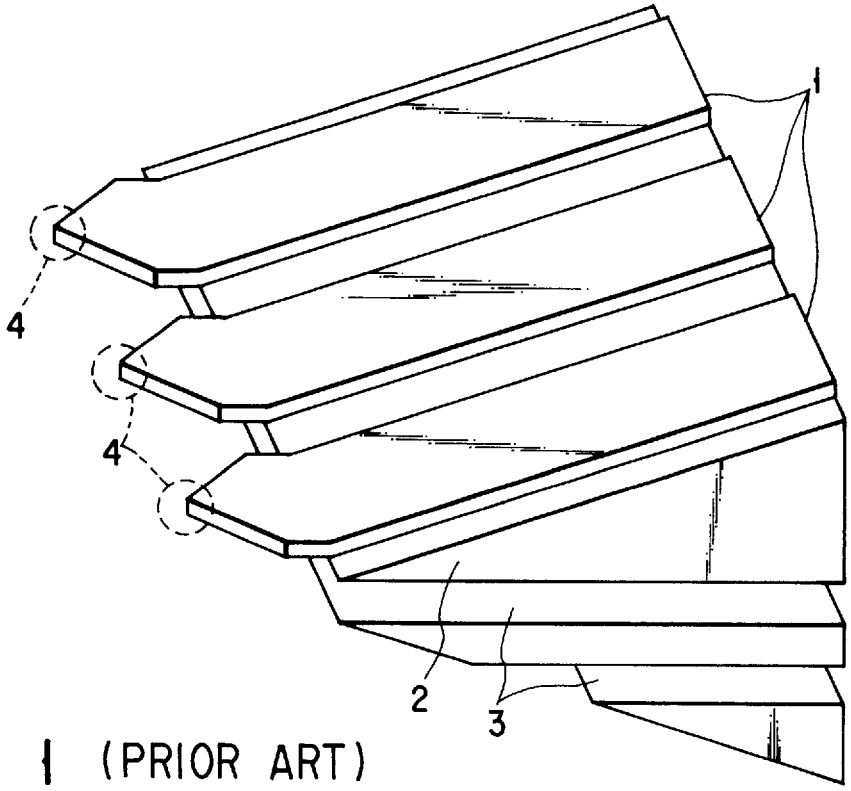
FIG. 1 (PRIOR ART)
FIG. 1 is a drawing of a conventional ink-jet printing head.
Figure 2:
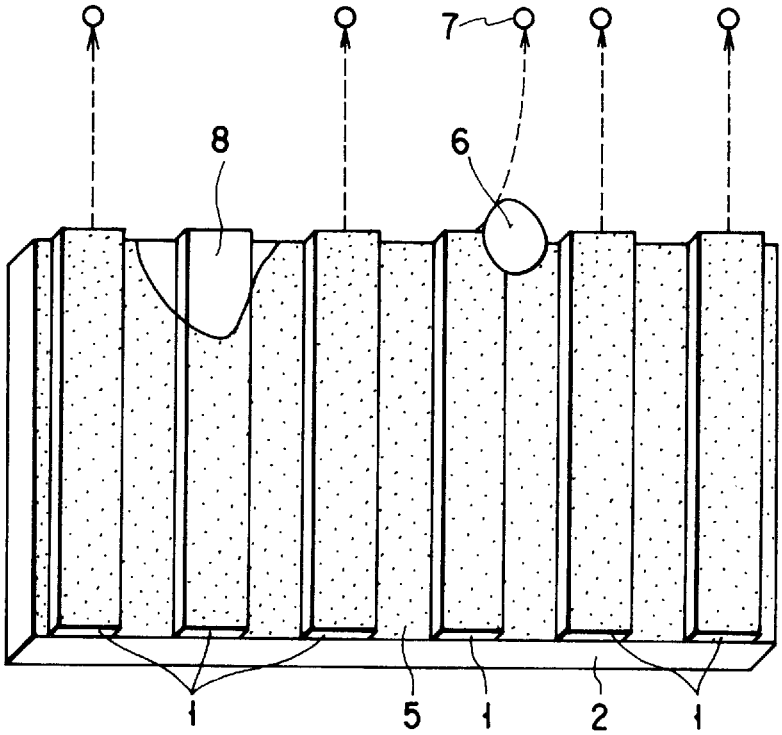
FIG. 2 (PRIOR ART)
FIG. 2 is a drawing of another conventional ink-jet printing head and a hindrance liable to occur.
Figure 3:
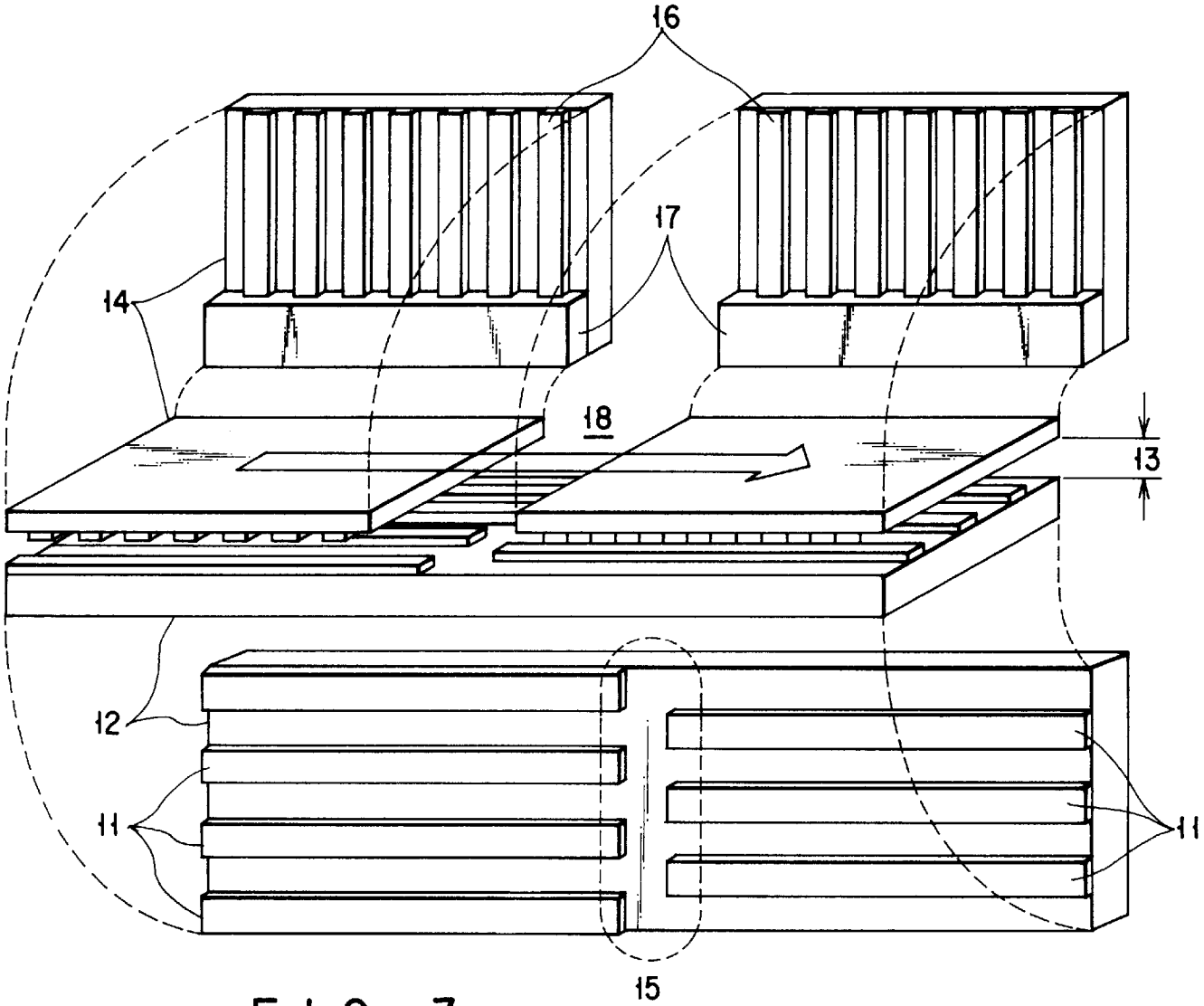
FIG. 3 shows the configuration of a printing head in an ink-jet printer according to a first embodiment of the present invention.

FIG. 3 shows the configuration of the printing head section in an ink-jet printer according to the present invention. In the figure, on the surface of a main substrate 12, a main electrode array 11 is provided which is composed of a plurality of parallel electrodes, or strip-like electrodes, to which a printing signal voltage to force at least the coloring material components in the ink to fly is applied. Above the surface of the main substrate 12 on which the main electrode array 11 is provided, an auxiliary substrate 14 is provided via a spacer (not shown) of nearly 300 $\mu$m in thickness so as to be a flat plate parallel with the main substrate 12 and form an ink supplying passage 13 between the main substrate 12 and itself. On the inside surface of the auxiliary substrate 14, that is, the surface facing the main substrate 12, an auxiliary electrode array 16 composed of strip-like electrodes crossing at right angles with the main array 11 are provided. The auxiliary electrode array 16 causes the ink containing charged particles of the coloring material components to flow at the coloring material emitting point 15, thereby producing a concentrated state of charged particles.

FIG. 3 also shows the main substrate 12 and auxiliary substrate 14 and the main electrode array 11 and auxiliary electrode array 16 viewed from the inside. On the inside surface of the auxiliary substrate 14, an auxiliary electrode driver circuit 17 for driving the auxiliary electrode array 16 is also provided. Furthermore, the main electrode array 11 is provided so that the electrodes may be arranged in a staggered fashion toward the ink droplet emitting point 15 from the right and left directly under the ink droplet emitting outlet. Therefore, the edge portion of the electrode array 11 acting as the ink droplet emitting point 15 make a structure that realizes a printing resolution twice the arrangement pitch of the electrode array 11 on each of the right and left auxiliary electrode array 16 sides.

At the auxiliary substrate 14, an ink droplet emitting outlet 18 made up of a slit-like opening is formed in the position directly above the ink droplet emitting point 15. The auxiliary electrode array 16 is used to carry the coloring material from right and left toward the ink droplet emitting outlet 18 and concentrate the material, and is arranged in parallel with the ink droplet emitting outlet 18. Printing paper is transported in the direction, for example, indicated by the arrow in FIG. 3. Dots are formed on the paper by the ink droplets flown from the ink droplet emitting outlet 18, whereby an image is printed.

An ink returning mechanism (not shown) including a pump supplies the ink to the ink supplying passage 13 from the right side of FIG. 3, for example. The ink is such that, for example, a positively charged coloring component, together with an electrification control agent and a binder, are distributed and floated in a colloidal state in an insulating solvent of $10^{-8}$ Ωcm or more. The coloring material may be pigment or dye. The solvent may be water or Iso parphine. After the ink supplied to the ink supplying passage 13 has passed through the ink droplet emitting point 15, it passes through an ink recycling passage (not shown) and is gathered into the ink returning mechanism.

Figure 4:
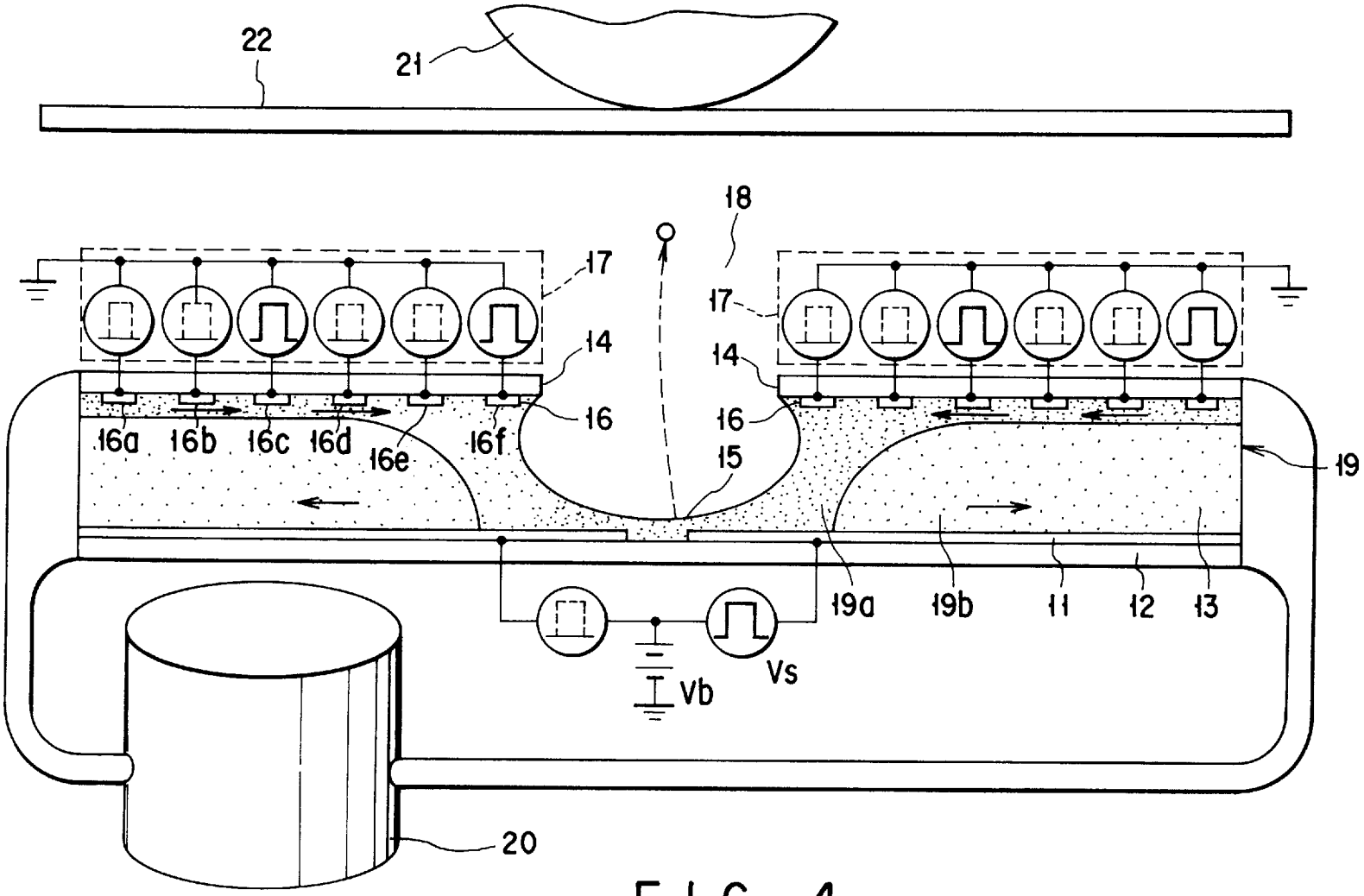
FIG. 4 is a diagram to help explain the operation at the time when the ink-jet printer to which the printing head of FIG. 3 is applied is in printing operation.
Figure 5:
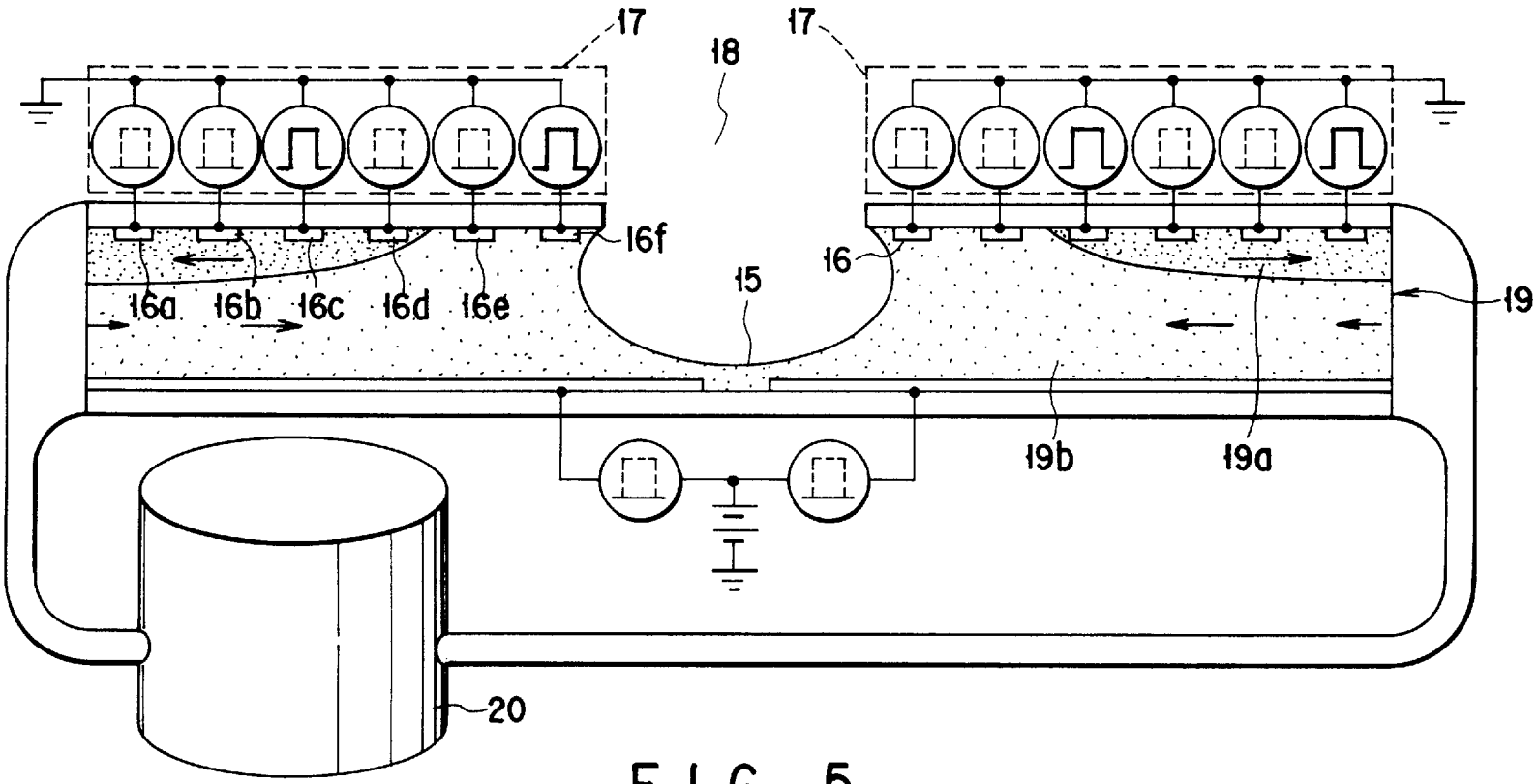
FIG. 5 is a diagram to help explain the operation at the time when the ink-jet printer using the printing head of FIG. 3 is not in printing operation.

Next, the operation of the first embodiment will be described with reference to FIGS. 4 and 5. FIG. 4 is a conceptual diagram of the ink-jet printer of the first embodiment in printing operation. In FIG. 4, part of the ink passage 13 in FIG. 3 is enlarged to explain the operation of the auxiliary electrode driver circuit 17 and the resulting motion of the coloring material component 19*a* in the ink 19. Although in FIGS. 4 and 5, the coloring material component 19*a* and the solvent component 19*b* in the ink 19 are separated for the sake of an understanding of the operation, they are actually not separated completely and reference symbol 19*a* indicates the ink having high concentration of the coloring material component and reference symbol 19*b* represents the ink having low concentration of the same.

The main electrode array 11 is applied with, for example, a direct-current bias voltage Vb of 1.5 kV. Furthermore, a 500-V pulse voltage is superposed on the bias voltage Vb as a printing signal voltage Vs according to the image signal to emit and force ink droplets to fly, which is applied to the main electrode array. The bias voltage Vb is applied to all of the main electrodes of the main electrode array 11, and the printing signal voltage Vs is selectively applied to only the electrodes corresponding to the pixels to be printed in the main electrode array 12.

Figure 6A:
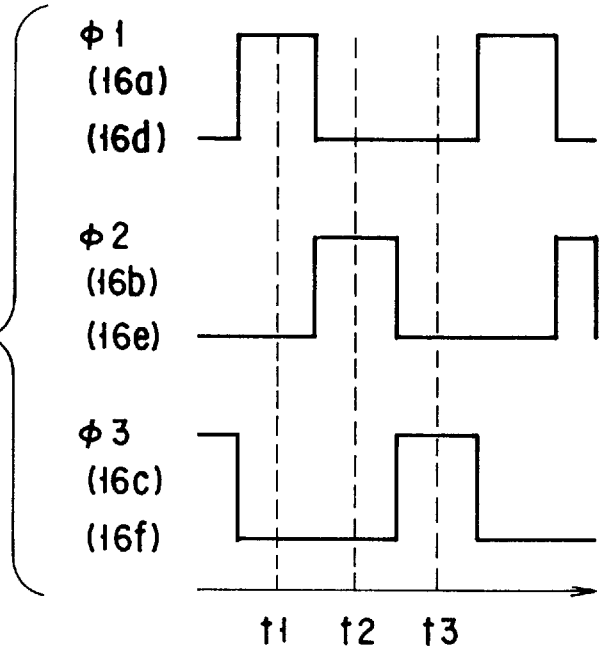
FIGS. 6A and 6B illustrate the waveforms of a voltage applied to the auxiliary electrode array of the printing head of FIG. 3.

The auxiliary electrode array 16 is driven during normal printing operation as follows. The auxiliary electrode driver circuit 17 applies pulse trains of three phases ϕ1, ϕ2, and ϕ3 shown in FIG. 6A to a group of electrodes 16*a*, 16*b*, 16*c*, 16*d*, 16*e*, and 16*f* shown in FIG. 4. As shown in FIG. 6A, the pulse trains of three phases undergo phase shift control so that the voltage applying position may move one by one toward the ink droplet emitting point 15 as time elapses. The phase speeds and voltage values of these voltage pulse trains ϕ1, ϕ2, and ϕ3 are determined on the basis of the mobility of the coloring material component 19*a* in the ink 19, the repeat interval of the auxiliary electrode array 16, and the necessary amount of coloring material fed to the ink emitting outlet 18. Actually, however, an experiment using the voltage and pulse applying period as parameters enables the phase speeds and voltage values to be obtained easily from the conditions under which the ink flows most efficiently. The voltage value of the voltage pulse trains applied to the auxiliary electrode array 16 must be made lower than the voltage applied to the main electrode array 11 in order not to hinder the force of the electric field caused by the voltage applied to the main electrode array 11 from concentrating the coloring material component 19*a*.Therefore, in the embodiment, the voltage value of the voltage pulse train must be lower than 1.5 kV. Taking into account the idea of realizing the auxiliary electrode driver circuit 17 using an IC (integrated circuit), it is desirable that the voltage value should be several tens volts or lower.

When the voltage pulse trains having the voltage value and phase speeds thus optimized are applied to the auxiliary electrode array 16, the charged coloring material component 19*a* moved onto the inside surface of the auxiliary substrate 14 from the ink 19 in the ink supplying passage 13 is conveyed to the ink droplet emitting point 15, or the vicinity of the ink droplet emitting outlet 18, in such a manner that the coloring material component slides over the surface of the auxiliary substrate 14 at the same speed as the phase speed of the voltage pulse trains.

In the auxiliary electrode array 16*a* to 16*f* to the left of the ink droplet emitting point 15 shown in FIG. 4, a voltage pulse with a phase of ϕ1 is applied to the auxiliary electrodes 16*a* and 16*d* at timing tl shown in FIG. 6A. Therefore, the positively charged coloring material components existing to the right of the auxiliary electrodes 16*a* and 16*d* undergo the force pushing to the right side (ink droplet emitting point 18) by the electrostatic repulsion from the auxiliary electrodes 16*a* and 16*d*, and move through migration. Next, when a voltage pulse with a phase of ϕ2 is applied to the auxiliary electrodes 16*b* and 16*e* at timing t2 that the coloring material components subjected to the electrostatic repulsion from the auxiliary electrodes 16*a* and 16*b* and moved to the right have just passed over the auxiliary electrodes 16*b* and 16*e* to the right of the auxiliary electrodes 16*a* and 16*d*, the coloring material components then receive the electrostatic repulsion from the auxiliary electrodes 16*b* and 16*e* and move further to the right. Next, when a voltage pulse with a phase of ϕ3 is applied to the auxiliary electrodes 16*c* and 16*f* at timing t3 that the coloring material components subjected to the electrostatic repulsion from the auxiliary electrodes 16*b* and 16*e* and moved to the right have just passed over the auxiliary electrodes 16*c* and 16*f* to the right of the auxiliary electrodes 16*b* and 16*e*, the coloring material components then receive the electrostatic repulsion from the auxiliary electrodes 16*c* and 16*f* and move further to the right.

In this way, the coloring material components 19*a* moved onto the auxiliary substrate 14 receive the electrostatic repulsion from the individual auxiliary electrodes 16*a* to 16*f* in the auxiliary electrode array 16 driven by the 3-phase voltage pulse and thereby move toward the ink droplet emitting point 15 by migration at the same speed as the phase speed of the voltage pulse trains.

If the coloring material components have existed to the right of the auxiliary electrodes 16*a* and 16*b* when a voltage pulse is applied to the auxiliary electrodes 16*a* and 16*d*, these coloring material components will receive electrostatic repulsion to the left, that is, in the direction opposite to the ink droplet emitting point 15. Here, as seen from FIG. 6A, when the auxiliary electrode array 16 is driven by the 3-phase voltage pulse train, the retreat phase speed is twice the advance phase speed. Specifically, when a voltage pulse with a phase of ϕ1 is applied to the auxiliary electrodes 16*a* and 16*d* at timing tl in FIG. 6A, the coloring material components existing to the left of the auxiliary electrodes 16*a* and 16*b* receive electric repulsion in the retreating direction and move back to the left. At next timing t2, a voltage pulse with a phase of ϕ2 applied to the auxiliary electrodes 16*b* and 16*e* makes the coloring material components retreat further to the left. Therefore, during the interval between timing t1 and timing t2 , the coloring material components move back to the left twice the distance they move forward to the right, with the result that the retreat phase speed is twice the advance phase speed. By setting the voltage value and period of the voltage pulse train so that the coloring material components may depart at the double speed from the range where the migration of the coloring material components determined by the field mobility can take place, the coloring material components 19*a* can be prevented from moving in the retreating direction.

As described above, when the auxiliary electrode driver circuit 17 applies to the auxiliary electrode array 16 a phase-shift-controlled voltage moving time-sequentially toward the ink droplet emitting point 15, the charged coloring material components 19*a* move in such a manner that they slide over the auxiliary substrate surface at the same speed as the phase speed, and are accumulated at the ink droplet emitting outlet 18 in a concentrated state. With the coloring material components accumulated at the ink droplet emitting outlet 18 above the ink droplet emitting point 18, when the printing signal voltage Vs superposed on the bias voltage Vb is applied to the main electrode array 12, the force that is exerted from the electric field enhanced by the application of the printing signal voltage Vs on the charged particles exceeds the surface tension of the ink 19. As a result, the ink droplets fly in the air at the opposite electrode 21, thereby forming a pixel on printing paper 22, a printing medium placed in front of the opposite electrode 21.

Since the solvent 19*b*, the other component in the ink 19, has no charge in it, it flows so as to depart from the ink droplet emitting outlet 18 in the opposite direction to the flow of the coloring material components 19*a* in the ink passage 13, and is sent to an ink reservoir 20. Specifically, in the ink passage 13, the following two flows coexist: one flow receiving more of the force from the auxiliary electrode array 16 and heading for the tip of the electrode because of a lot of coloring material components 19*a*, charged floating particles, and the other flow being pushed back by the coloring-material-rich flow and departing from the tip of electrode because of a small amount of floating coloring materials. The coexistence of the two flows causes convection in the ink passage route including the ink reservoir 20.

As described above, with the first embodiment, in a normal printing operation, the coloring material components 19*a* are sent to the ink droplet emitting point 15 as shown in FIG. 4 to maintain the concentrated state. On the other hand, during at least a particular period in a non-printing operation, for example, immediately after the power of the printing apparatus has been turned on, or when a printing operation is started again after the emission of ink droplets has been stopped more than a specific period of time, the first embodiment sends the coloring material components 19*a* so that they may depart from the ink droplet point 15, which is the reverse of the printing operation as shown in FIG. 5, and thins the concentration of the coloring material components or makes the concentration of the coloring material components almost zero. This prevents the coloring material components 19*a* from adhering to the electrode at the ink droplet emitting point 15 and drying up.

Figure 6B:
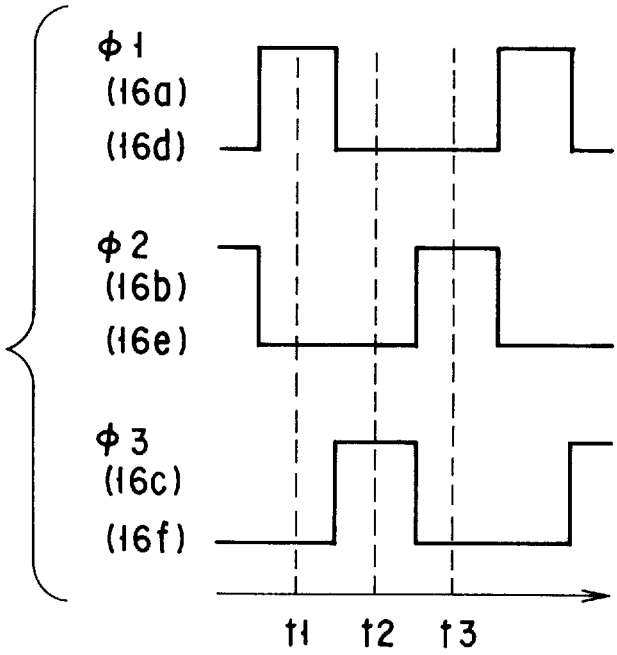

Here, the process of sending the coloring material components 19*a* in the opposite direction to the ink droplet emitting point 15 will be explained with reference to FIG. 5. FIG. 5 is a conceptual diagram of the ink-jet printer in a non-printing operation. In the figure, to explain the operation of the auxiliary electrode driver circuit 17 and the resulting motion of the coloring material components 19*a* in the ink 19, part of the ink passage 13 in FIG. 3 is enlarged as in FIG. 4. Here, as shown in FIG. 6B, the auxiliary electrode driver circuit 17 is controlled so as to cause a moving electric field whose phase shift retreats on the auxiliary electrode array, which is the complete reverse of the printing operation. Specifically, the operation of the portion to the left of the ink droplet emitting point 15 in FIG. 5 will be considered as in the above printing operation. At timing t1 shown in FIG. 6B, a voltage pulse with a phase of $\phi$1 is applied to the auxiliary electrodes 16*c* and 16*f*. As a result, the positively charged coloring material components existing to the left of the auxiliary electrodes 16*c* and 16*f* undergo the force pushing to the left side by the electrostatic repulsion from the auxiliary electrodes 16*c* and 16*f*, and move through migration. Next, when a voltage pulse with a phase of $\phi$3 is applied to the auxiliary electrodes 16*b* and 16*e* at timing t2 that the coloring material components subjected to the electrostatic repulsion from the auxiliary electrodes 16*c* and 16*f* and moved to the left have just passed over the left auxiliary electrodes 16*b* and 16*e* adjacent to the auxiliary electrodes 16*c* and 16*f*, the coloring material components then receive the electrostatic repulsion from the auxiliary electrodes 16*b* and 16*e* and move further to the left. Next, when a voltage pulse with a phase of $\phi$2 is applied to the auxiliary electrodes 16*c* and 16*f* at timing t2 that the coloring material components subjected to the electrostatic repulsion from the auxiliary electrodes 16*b* and 16*e* and moved to the left have just passed over the right auxiliary electrodes 16*c* and 16*f* adjacent to the auxiliary electrodes 16*b* and 16*e*, the coloring material components then receive the electrostatic repulsion from the auxiliary electrodes 16*c* and 16*f* and move further to the left.

In this way, during a non-printing operation, the coloring material components 19*a* moved onto the auxiliary substrate 14 receives the electrostatic repulsion sequentially from the individual auxiliary electrodes 16*a* to 16*f* in the auxiliary electrode array 16 driven by the 3-phase voltage pulse, and thereby continue moving by migration in the opposite direction to the ink droplet emitting point 15 at the same speed as the phase speed of the voltage pulse train. Specifically, by keeping the coloring material components needed in printing further away from the ink droplet emitting point 15 in a non-printing operation and leaving the solvent component 19*b*, the other component in the ink 19, it is possible to avoid troubles arising from the precipitation of the coloring material near the ink droplet emitting outlet 18 or the ink droplet emitting point 15, the adhesion of the coloring material to them, or the drying of the electrode surface of the main electrode array 11 and auxiliary electrode array 16.

Furthermore, with the first embodiment, the ink droplet emitting outlet 18 composed of a slit-like opening is provided in the auxiliary substrate 14 in the vertical direction opposite to the direction in which gravity acts, and ink droplets are emitted and forced to fly. This provides the advantage that lines of electric force extend in the vertical direction and therefore an upward electric field needed for ink emission is easier to form. When the ink droplets are emitted and forced to fly in the horizontal direction, gravity must be dealt with by only surface tension to prevent leakage of ink. Therefore, it is difficult to make an ink droplet outlet with a diameter of 100 $\mu$m when a positive pressure is applied to the ink. Even when negative pressure is applied to the ink, it is difficult to make an opening with a diameter of 500 $\mu$m or more. With the first embodiment, however, emitting and forcing the ink droplets to fly in the vertical direction eases the aforementioned limitations and the opening of the ink droplet emitting outlet 18 can be widened. A wider opening of the ink droplet emitting outlet 18 facilitates the head processing and makes it easier to keep the surface of the head including the ink droplet emitting outlet 18 clean.

Furthermore, when the printing head section suffers a mechanical shock, the ink flooded out of the ink droplet emitting outlet 18 gathers on the surface of the auxiliary substrate 14, preventing the ink from leaking continuously in large quantities. Even when the ink is moved as described earlier to prevent the electrode from drying, there is no possibility that the ink leaks.

Furthermore, with the first embodiment, the main electrode array 11 is provided in such a manner that the electrodes are arranged from right and left in a staggered fashion so as to face the ink droplet emitting point 15 located under the ink droplet emitting outlet 18. This makes the electrode arrangement pitch twice the pitch on both of the right and left sides at the edge portion of the electrode array 11 serving as the ink droplet emitting point 15. Therefore, as compared with the case where the auxiliary electrodes are arranged just in a line, the printing resolution, that is, the density of pixels in the main scanning direction on the printing paper 22, can be doubled.

Figure 7:
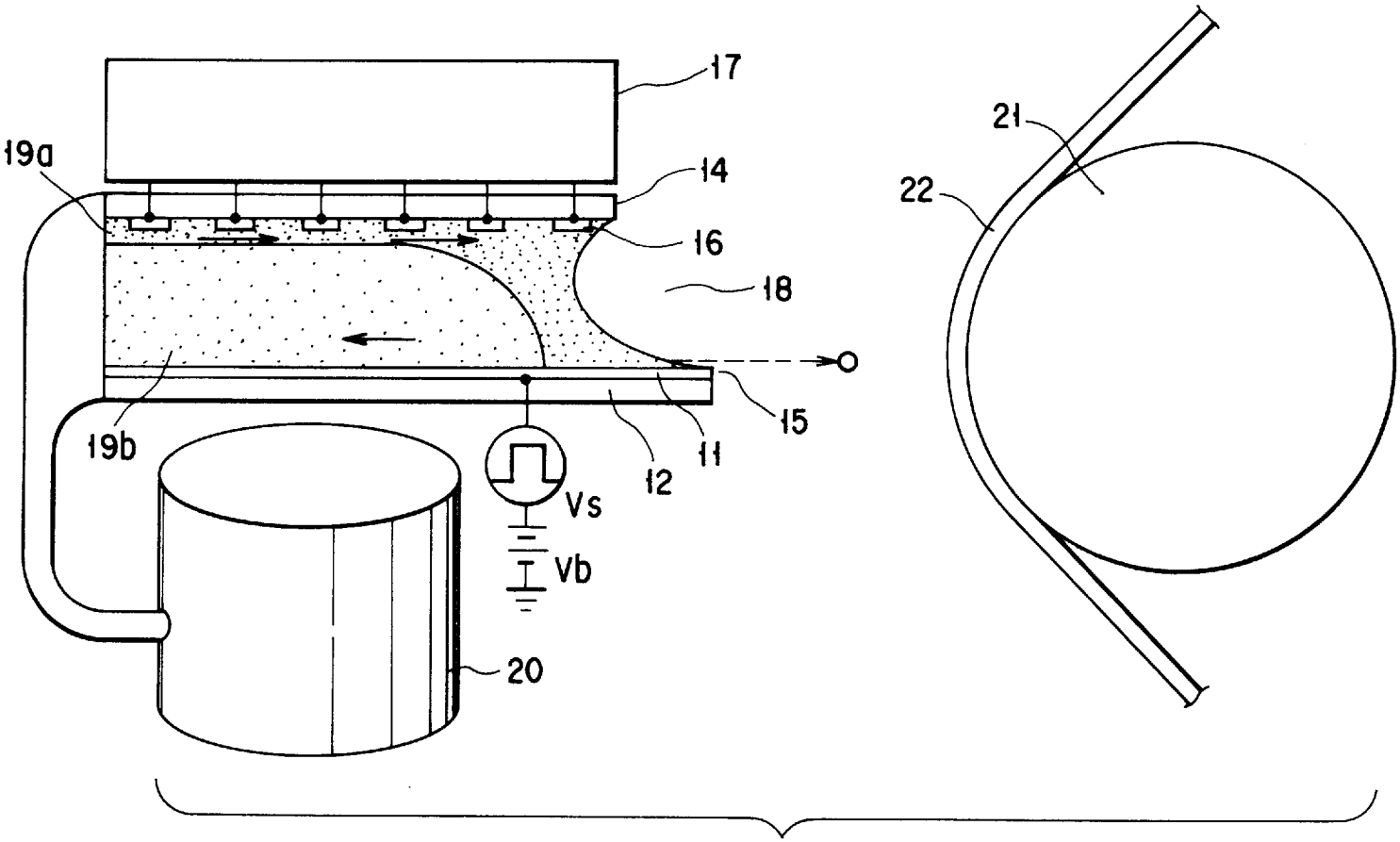
FIG. 7 shows the configuration of a printing head in an ink-jet printer according to a second embodiment of the present invention, including a diagram to help explain the operation of the ink-jet printer in printing operation.
Figure 8:
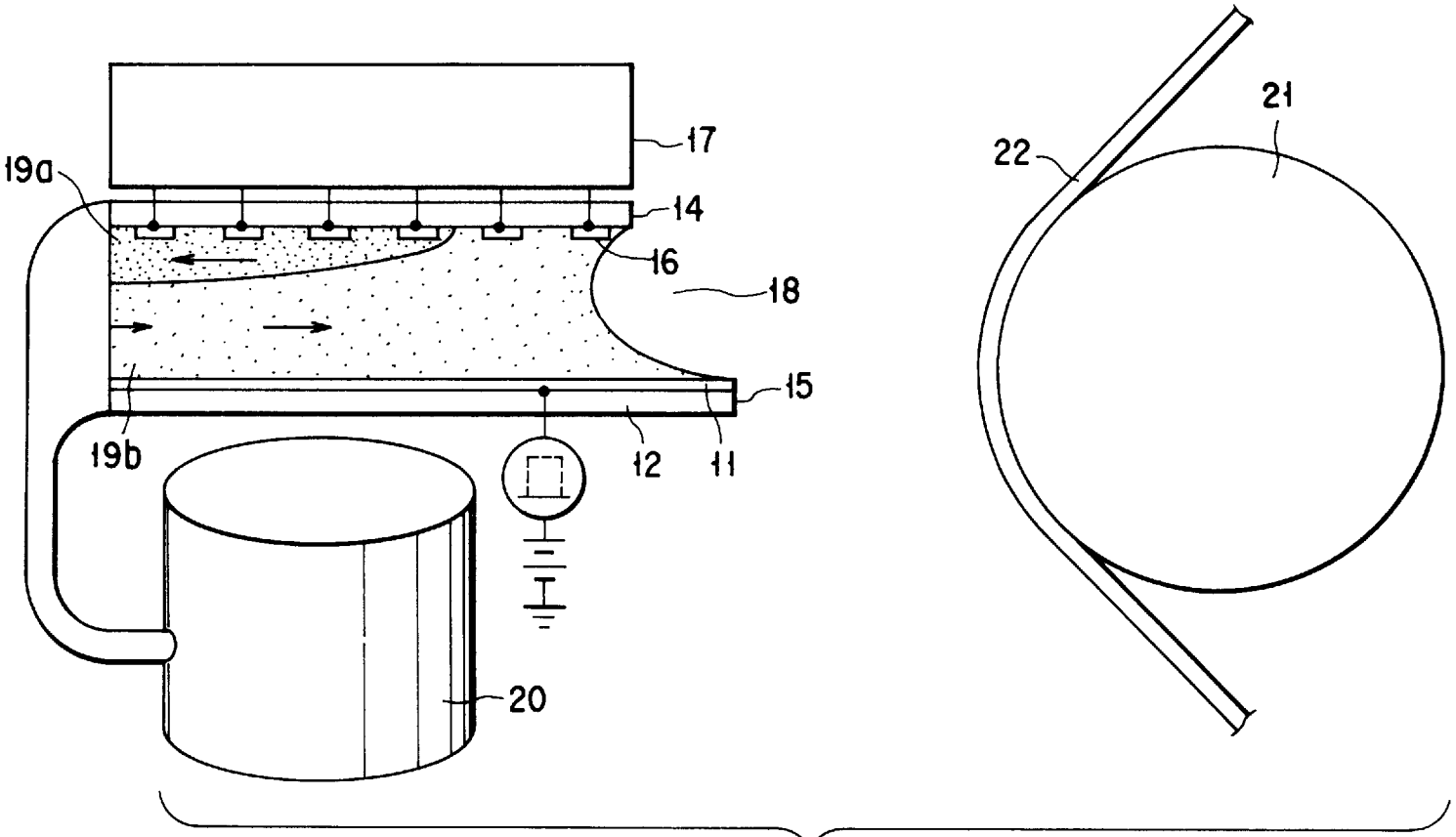
FIG. 8 is a diagram to help explain the operation of the ink-jet printer of the second embodiment out of printing operation.

Hereinafter, referring to FIGS. 7 and 8, a second embodiment of the present invention will be explained. The same components as those in the magnetic head explained in the first embodiment will be indicated by the same reference symbols.

In the first embodiment, a configuration that emits and forces ink droplets to fly from the ink droplet emitting outlet 18 formed as an opening in the auxiliary substrate 16 in the direction perpendicular to the substrate surface has been explained (hereinafter, the configuration is referred to as the side shooter type). As seen from FIGS. 3 and 5, the printing head applied to the ink-jet printer of the first embodiment has a symmetrical structure with respect to the ink droplet emitting outlet 18. In the second embodiment, as shown in FIG. 7, a printing head taking the form of a half of the printing head of the first embodiment is used, taking into account the symmetry of the printing head of the first embodiment. In this case, the ink droplet emitting outlet 18 is formed between the end of the main substrate 12 and the end of the auxiliary substrate 14, and ink droplets are emitted and forced to fly in the direction almost parallel to the substrates 12 and 14. The emitted ink droplets reach the printing paper 22 on the opposite electrode 21 placed so as to face the ends of the substrates 12 and 14.

Because the operation of the printing head of the second embodiment in and out of printing operation are the same as in the first embodiment, a detailed explanation of them will be omitted. Even with a printing head of the side shooter type that emits ink droplets from the side of the substrate, the printing head of the second embodiment sends the coloring material components 19*a* in the ink 19 toward the ink droplet emitting outlet 18 in a printing operation as shown in FIG. 7, whereas it sends the coloring material components 19*a* in the ink 19 in the direction opposite to the ink droplet emitting outlet 18 in a non-printing operation as shown in FIG. 8. This produces the same effect as with the first embodiment. Specifically, it is possible to prevent the following phenomena: the precipitation of the coloring material components near the ink droplet emitting outlet 18 or the ink droplet emitting point 15, the adhesion of the coloring material components to them, and the drying of the electrode surface.

Next, a third embodiment of the present invention will be described with reference to FIGS. 9 and 10. The same components as those in the head explained in the first embodiment will be indicated by the same reference symbols.

A printing head applied to the ink-jet printer of the third embodiment is provided with a gate electrode 23 exclusively used for control of the coloring material components 19*a* near the ink droplet emitting outlet 18 in addition to the auxiliary electrode array 16 of the first and second embodiments. The gate electrode 23 is a dedicated electrode for keeping the coloring material components 19*a* away during a non-printing operation of the ink-jet printer.

Figure 9:
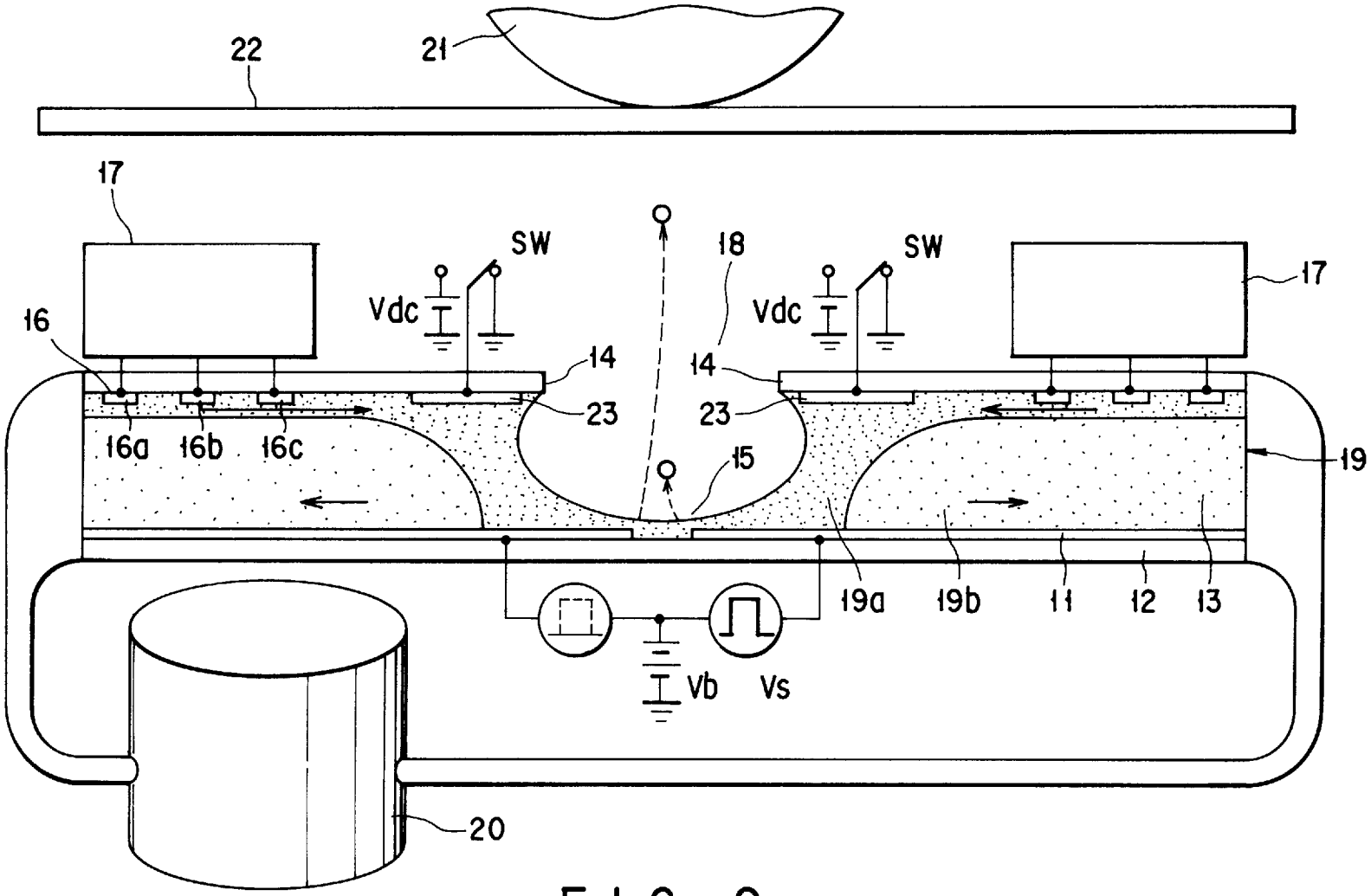
FIG. 9 shows the configuration of a printing head in an ink-jet printer according to a third embodiment of the present invention, including a diagram to help explain the operation of the ink-jet printer in printing operation.
Figure 10:
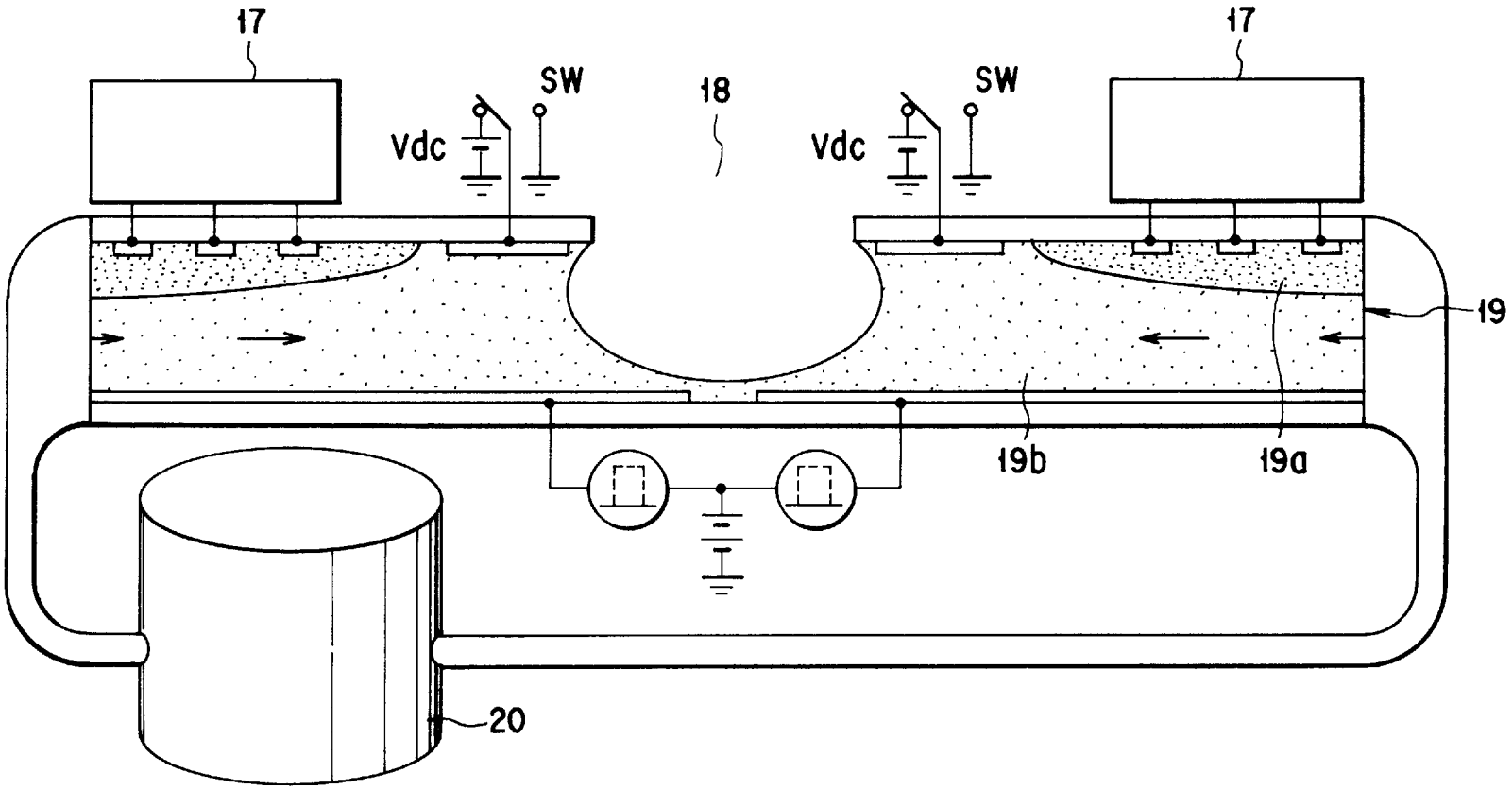
FIG. 10 is a diagram to help explain the operation of the ink-jet printer of the third embodiment not in printing operation.

In a printing operation of the ink-jet printer, a direct-current voltage Vdc or the ground potential is applied to the gate electrode 23 via a switch SW as shown in FIG. 9. When the apparatus continues to be out of operation, the switch SW is changed so that the direct voltage Vdc of the same polarity of the charge of the coloring material may be applied to the gate electrode 23 as shown in FIG. 10, thereby keeping the coloring material components 19*a* away from the ink droplet emitting outlet 18.

When the ink-jet printer is in and out of printing operation, a pulse voltage similar to that in the first embodiment is applied to the individual electrodes in the auxiliary electrode array 16. In a printing operation, they are controlled so that the coloring material components 19*a* may be sent toward the ink droplet emitting outlet 18, whereas in a non-printing operation, they are controlled so that the coloring material components 19*a* may be sent in the direction opposite to the ink droplet emitting outlet 18.

According to the third embodiment, use of the gate electrode 23 enables the voltage and operation timing to be set independently from the auxiliary electrode array 16 for sending and concentrating the coloring material components 19*a* in the process of sending the coloring material component 19*a* in the opposite direction to the ink droplet emitting outlet 18, or the process of keeping the coloring material components away from the ink droplet emitting outlet 18. This assures the flexibility of control. Furthermore, by controlling the auxiliary electrode array 16 in the same manner as in the first embodiment, the same effect as in the first embodiment can be obtained. In a non-printing operation, the auxiliary electrode array 16 is not necessarily controlled as in the first embodiment. It may controlled by the gate electrode 23 only. The gate electrode 23 may also be allowed to function as an ordinary electrode, such as forming a meniscus before emission of ink droplets, separating the ink droplets, or accelerating the ink droplets at the time when the droplets start to fly.

Next, a fourth embodiment of the present invention will be explained with reference to FIGS. 11 and 12. The same components as those in the magnetic head explained in the first embodiment will be indicated by the same reference symbols.

Figure 11:
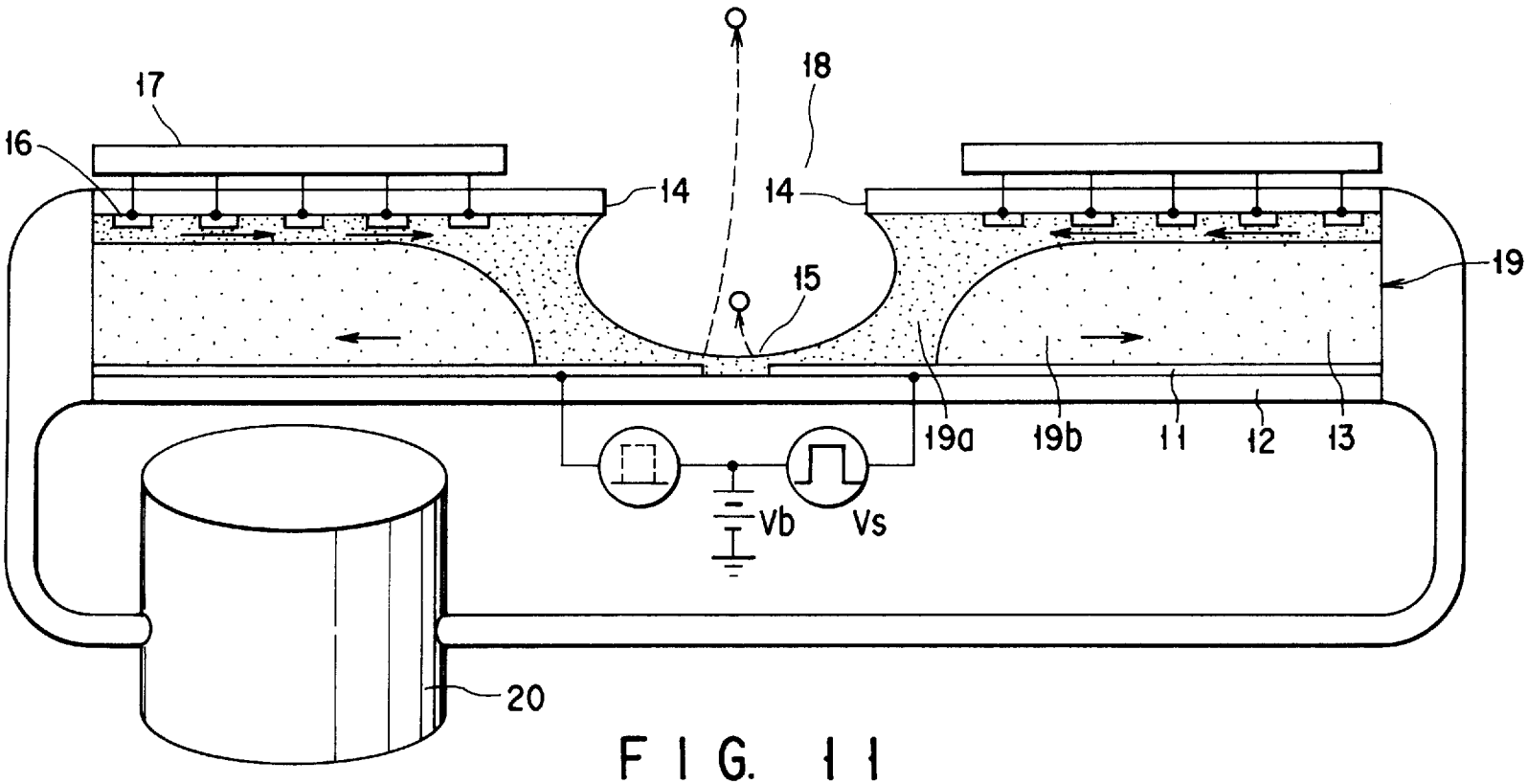
FIG. 11 shows the configuration of a printing head in an ink-jet printer according to a fourth embodiment of the present invention, including a diagram to help explain the operation of the ink-jet printer in printing operation.
Figure 12:
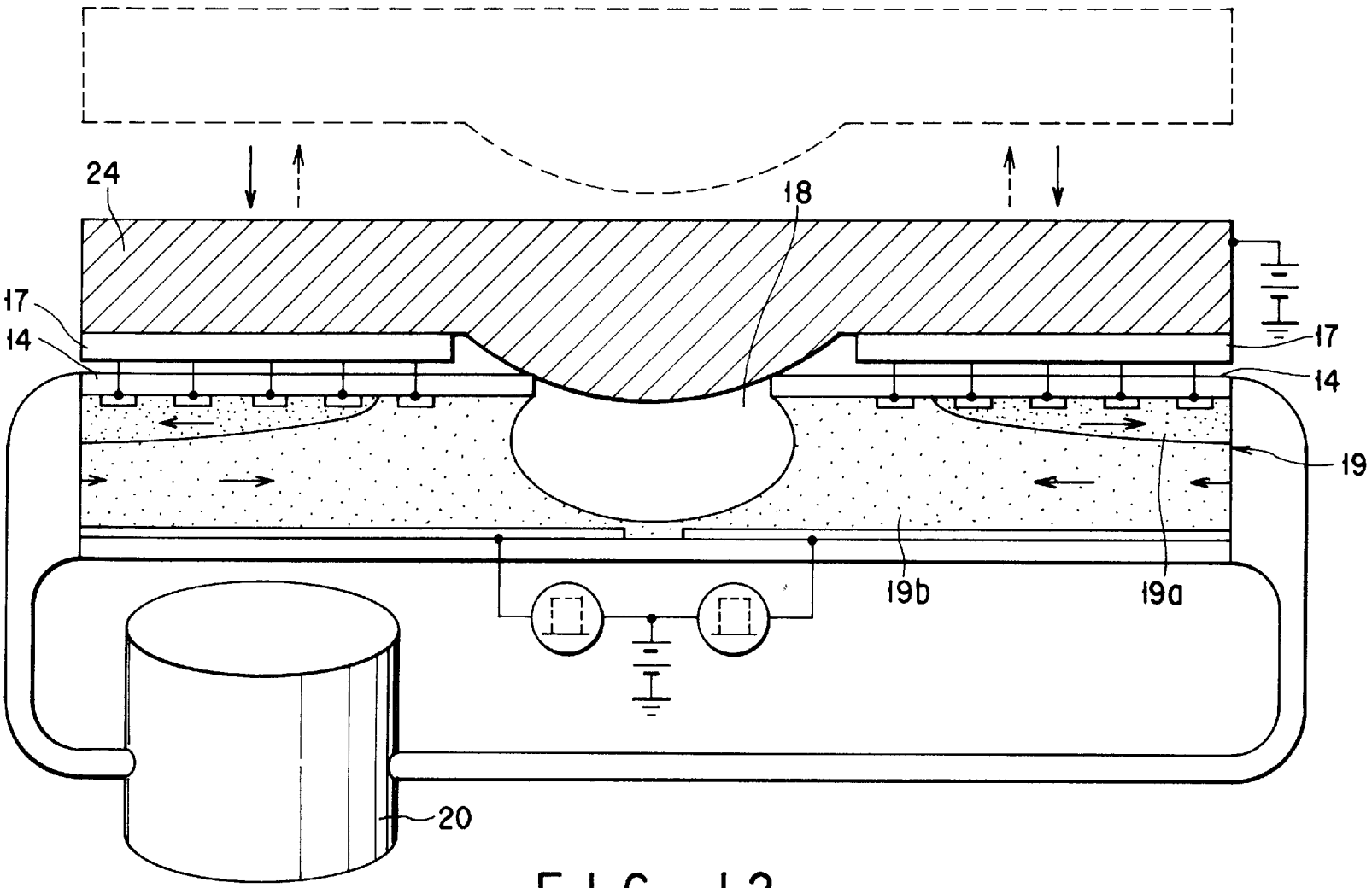
FIG. 12 is a diagram to help explain the operation of the ink-jet printer of the fourth embodiment not in printing operation.

Unlike the first to third embodiments, the fourth embodiment leaves the ink droplet emitting outlet 18 open in a printing operation as shown in FIG. 11 to keep the coloring material components 19*a* away from the ink droplet emitting outlet 18 in a non-printing operation. During a non-printing operation, for example, in the case where the out-of-operation period has exceeded a specific period of time, the ink droplet emitting outlet 18 is closed with a lid 24 as shown in FIG. 12.

A lid used with the printing head in a conventional ink-jet printer has the function of eliminating the cause of unstable ink droplet flying direction by scraping, wiping, or sucking the ink that did not fly and adhered to the tip of the nozzle, the function of preventing the ink from smearing or spilling, and the function of preventing the ink concentration from rising locally by suppressing evaporation of the ink within the ink nozzle.

In contrast, with the fourth embodiment, a voltage is applied to the lid 24 so that a force of repulsion may act on the coloring material components 19*a*, charged coloring material particles. This enables the solvent component 19*b* to be left near the ink droplet emitting outlet 18 and the coloring material components 19*a* to be kept away from the ink droplet emitting outlet 18. Specifically, the lid 24 is provided with an electrode for applying a voltage of the polarity that repels charged coloring material particles, or the lid itself is made conductive and acts as an electrode. When the lid 24 as a whole is conductive, a force of repulsion acts on the coloring material components 19*a* only near the ink droplet emitting outlet 18. In the other part, the force is shut off by the auxiliary substrate 14 and auxiliary substrate driver circuit 17 and does not act on the ink 19. As shown in FIG. 12, when the lid 12 closes the ink droplet emitting outlet 18, only the coloring material components 19*a*, charged particles, in the ink near the ink droplet emitting outlet 18 receive repulsion and move away from the ink droplet emitting outlet 18. Therefore, the ink solvent component 19*b* containing a small amount of coloring material components or almost no coloring material components is left near the ink droplet emitting outlet 18, preventing an obstacle, such as adhesion. This assures a similar effect to that of the first embodiment.

The voltage may be applied to the lid 24 all the time, or only when the ink droplet emitting outlet 18 is closed with the lid 24. The voltage applied to the lid 24 may be a direct-current voltage or a biased alternating-current voltage. As long as the voltage produces the same effect, its waveform may take any form.

It is effective that the same processing as in the first embodiment is performed on the auxiliary electrode array 16 in a printing operation, but in a non-printing operation, the same control is not necessarily needed.

Figure 13:
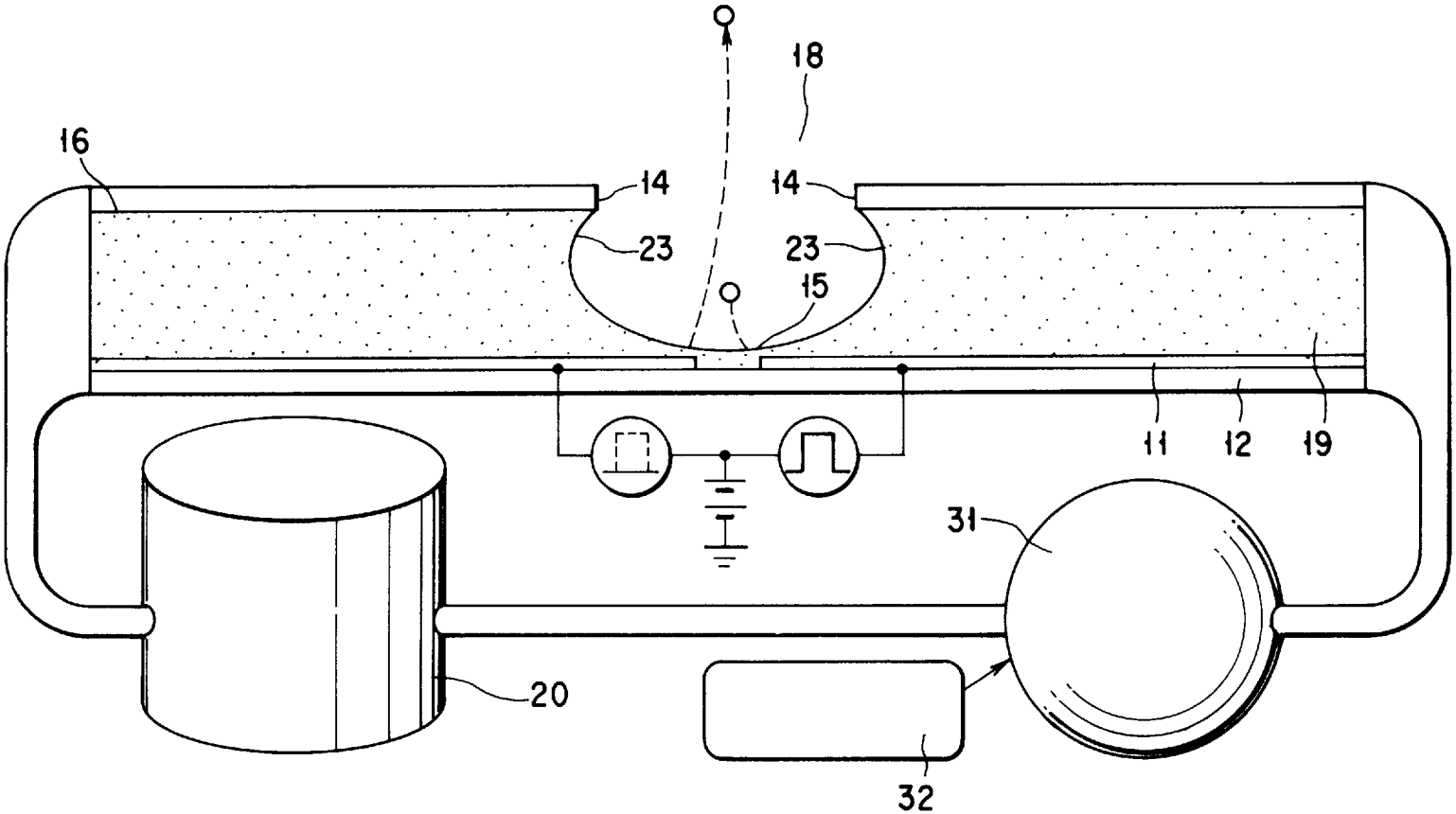
FIG. 13 shows the configuration of a printing head in an ink-jet printer according to a fifth embodiment of the present invention, including a diagram to help explain the operation of the ink-jet printer in printing operation.

Next, a fifth embodiment of the present invention will be described with reference to FIGS. 13 and 14. The same components as those in the magnetic head explained in the first embodiment will be indicated by the same reference symbols.

To carry out a normal printing operation in an ink-jet printing system that concentrates the coloring material components in the ink and emits and forces the ink, it is necessary to coat the main electrode array 11 with a thin film of ink 19 of 30$\mu$m or less in thickness, or to keep the electrode wet with the ink 19. With the fifth embodiment, ink pressure is controlled using a particular surface form determined by the contact angle between the ink material and electrode material and the surface tension of ink. In FIG. 13, a pump 31 and a pump control circuit 32 for controlling the pump 31 control the pressure applied to the ink 19.

Figure 14:
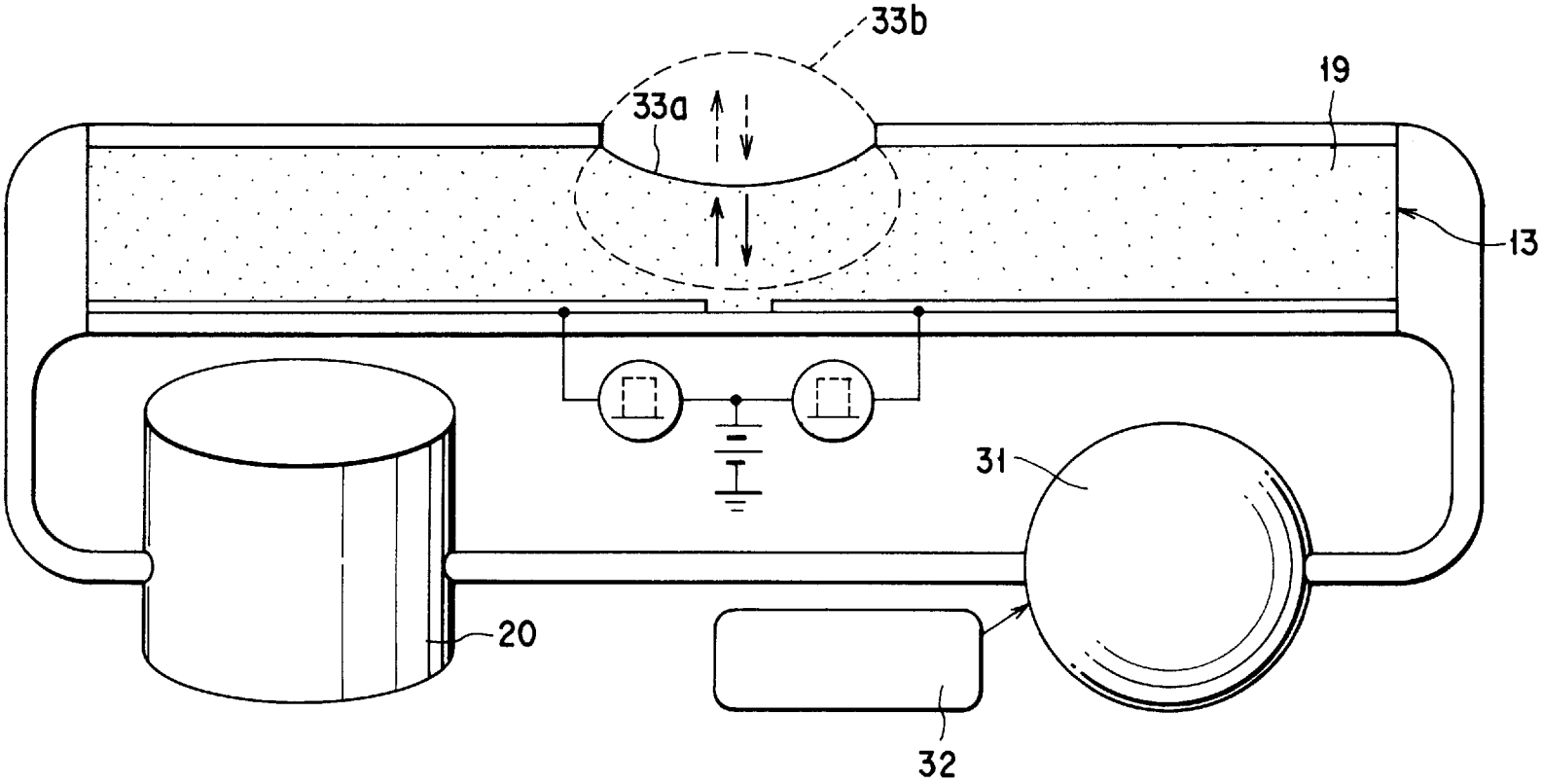
FIG. 14 is a diagram to help explain the operation of the ink-jet printer of the fifth embodiment not in printing operation.

FIG. 14 shows the state where pressure lower than atmospheric pressure is applied to the ink, or a negative pressure is applied to the ink 19, and the ink is drawn in from the vicinity of the ink droplet emitting outlet 18. In this state, when a normal printing operation is carried out, the flying state of the ink droplets will be always stable. When the apparatus has been out of operation for a relatively long time, or in a non-printing operation immediately after the power switch has been turned on, however, there is a possibility that the ink at the tip of the electrode has dried and the thin ink film has ruptured.

Therefore, under the conditions where such a state has happened or may take place, the fifth embodiment controls the pump 3 as shown in FIG. 14 and performs process of increasing the pressure applied to the ink 19 so as to form a thick ink layer on the main electrode array 11. When the pressure at that time is negative, the surface form of the ink 19 is a concave as shown by a solid line 33*a*.When the pressure is positive, the surface form is a convex as shown by a broken line 33*b*.As long as the purpose of wetting the surface of the main electrode array 11 is accomplished, the pressure applied to the ink 19 may be either positive or negative.

The ink pressure generally has the optimum value determined on the basis of the configuration and design of an ink-jet printer. The inventors of the present invention have found from experiments that since the distance between the printing head and the printing medium is normally a gap of about 1 mm, it is difficult with the present technology to observe the tip of the head in actual printing operation or ink droplets in the course of flying. Therefore, observation was made in a simulation experiment using a metal needle.

Figure 15A:
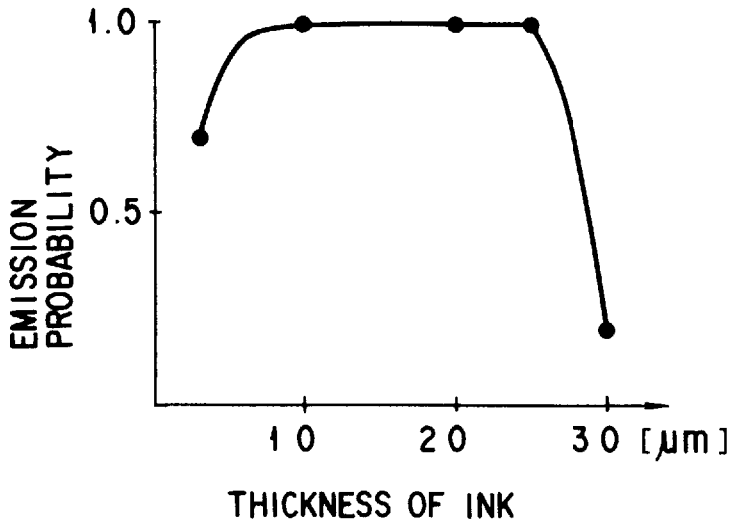
FIGS. 15A and 15B are graphs to explain optimal controlling of ink thickness in a printing operation or a non-printing operation.

As shown in FIG. 15A, the result has obtained that the flying mode in which the coloring material components in the ink were concentrated and emitted and forced to fly as intended by the invention took place when the thickness of the ink was 30 $\mu$m at most. It was also found that when the ink thickness exceeded 30 $\mu$m, this caused the ink to fly in a state without the unique merits as follows: the operation became unstable, the ink flew in a non-concentrated state, larger flying ink droplets slowed the operation and blurred the pixels. Therefore, it was confirmed by experiments that in a printing operation, the thickness of ink must be 30 $\mu$m or less. In FIG. 15A, a horizontal axis indicates a thickness of the ink on the tip of the head and a vertical axis indicates probability of ink emission from the head.

Figure 15B:
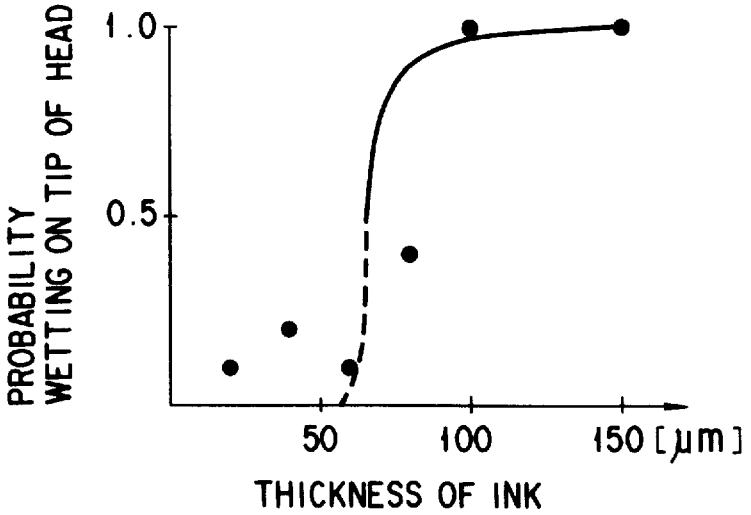

Furthermore, a simulation experiment was made in which the ink was advanced and retreated repeatedly over the plate-like electrode at various ink pressures to wet the tip of the actually dry head. The result in FIG. 15B showed that if the tip of the ink was a mass of at least 100 $\mu$m or more in diameter, it was able to advance and retreat smoothly. Namely, to restore the dry surface of the main electrode to a wet state, the pressure of the ink 19 is controlled so that the thickness of the ink may be at least 100 $\mu$m or more. In FIG. 15B, a horizontal axis indicates a thickness of the ink on the tip of the head and a vertical axis indicates probability of wetting on the tip of the head, that is, probability of that the ink is advanced over a fine obstruction on the plane substrate.

As described above, when the printing operation has been stopped for a relatively long time, or immediately after the power switch has been turned on, the main electrode can be wetted reliably and printing can be prevented from starting with the surface of the main electrode being dry.

In the fifth embodiment, the concentration of the coloring material components in the ink in wetting the tip of the main electrode is not particularly limited. When a small amount of coloring material or other solid material adheres to the surface of the dry main electrode, however, ink containing only solvent or no coloring material is apt to take in the coloring material adhering to the surface and when wetting the dry electrode, is less liable to precipitate. In this respect, combining the fifth embodiment with any of the first to fourth embodiments produces a greater effect.

Figure 16:
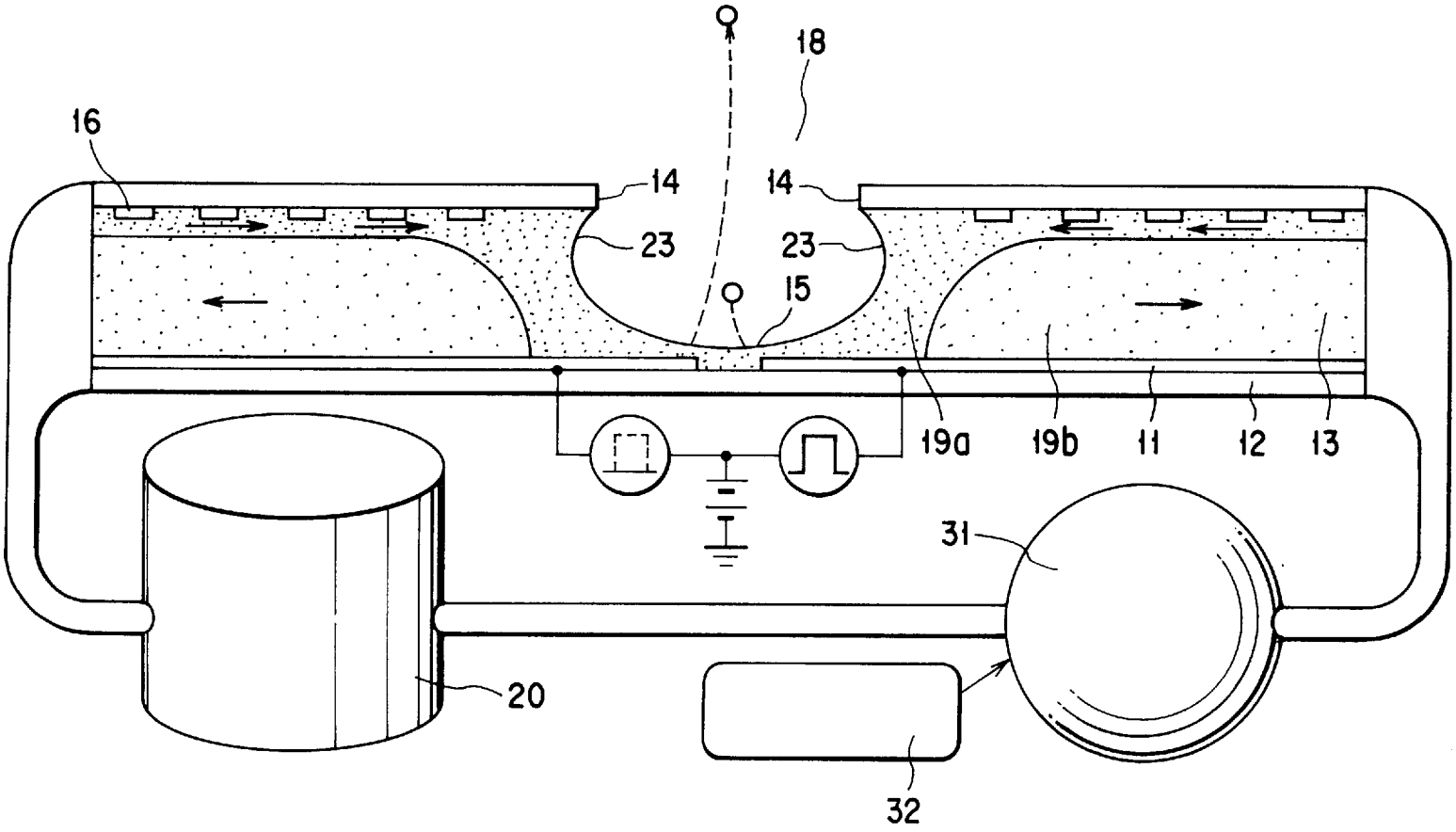
FIG. 16 shows the configuration of a printing head in an ink-jet printer according to a sixth embodiment of the present invention, including a diagram to help explain the operation of the ink-jet printer in printing operation.
Figure 17:
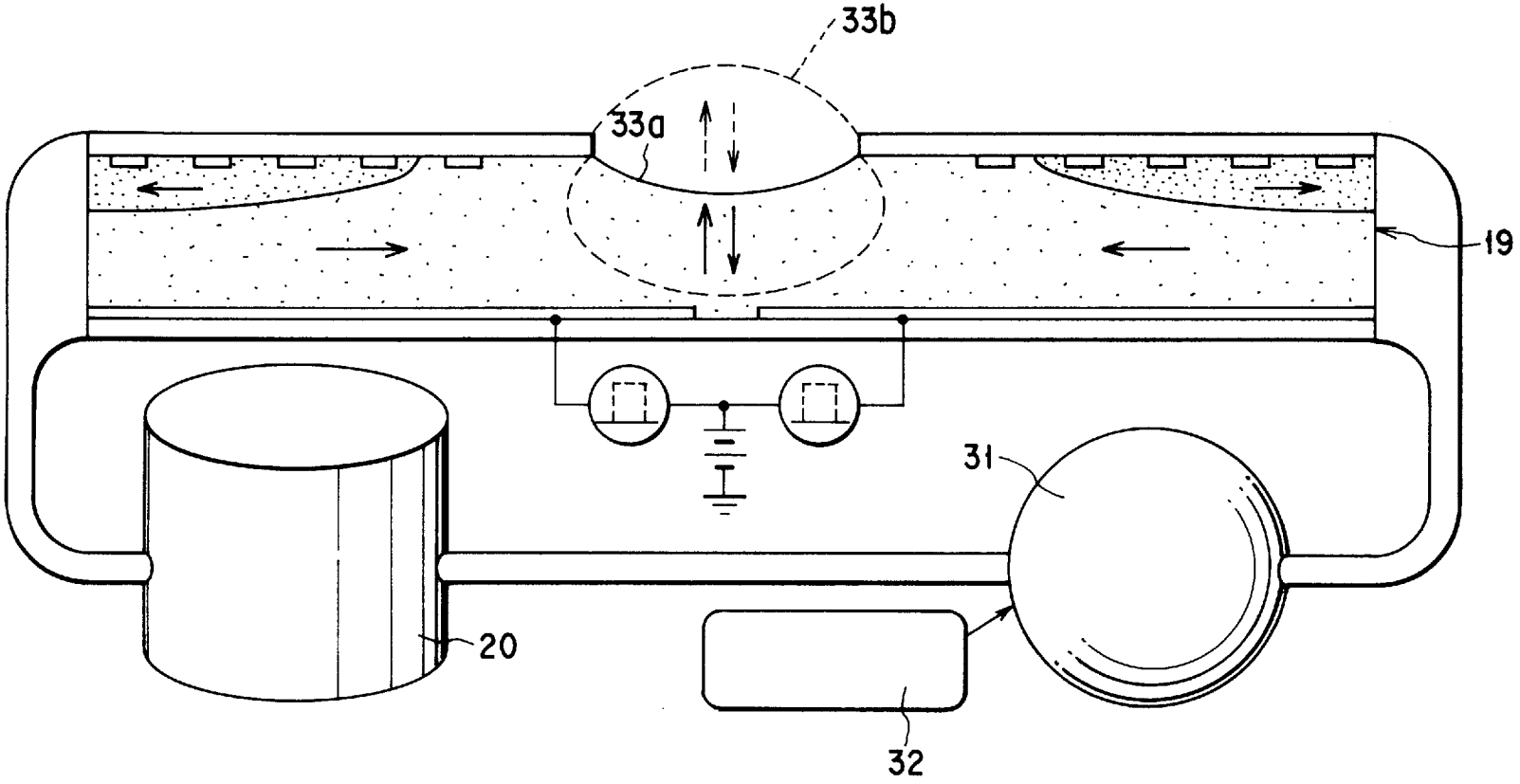
FIG. 17 is a diagram to help explain the operation of the ink-jet printer of the sixth embodiment not in printing operation.

Here, a sixth embodiment of the present invention will be shown in FIGS. 16 and 17. In the figures, the configuration of a printing head and its periphery is a combination of the first and fifth embodiments. FIG. 16 is a drawing to help explain a printing operation. FIG. 17 is a drawing to help explain a non-printing operation. Because the operation of the printing head includes the operation in the first and fifth embodiments, its detailed explanation will be omitted.

Like the first embodiment, the fifth embodiment uses the side shooter type configuration where the ink droplet emitting outlet 18 composed of a slit-like opening is provided in the vertical direction opposite to the direction in which gravity acts, and ink droplets are emitted and forced to fly in the direction perpendicular to the surface of the substrate. The configuration of the fifth embodiment may be combined with the edge shooter type configuration shown in the second embodiment.

Use of the side shooter type configuration provide the following merits. The side shooter type configuration has the advantage that the ink liquid film is less liable to rupture because the ink surface formed near the ink droplet emitting point 15 takes the form of a bridge structure supported by the surface tension of the surface connecting with both of the edges of the ink droplet emitting outlet 18 and the liquid on the right connects with the liquid on the left. Namely, an ink liquid surface form immune to dryness and impact can be produced. Since the ink is supported by only surface tension without a contact angle, a physical quantity, whose characteristic varies greatly with dirt, adsorption, or temperature, a stable characteristic is obtained. Furthermore, because the support is provided in the direction in which gravity acts on the ink, it is apparent that the ink is less liable to flood when an impact is exerted on the ink.

As described above in detail, with the first to sixth embodiments according to an ink-jet printer of the present invention, when the printing operation is stopped, the coloring material can be prevented from precipitating near the ink droplet emitting outlet or adhering to the outlet by keeping only the coloring material components in the ink away from the ink droplet emitting outlet and leaving the solvent component behind. Furthermore, when the printing operation has been stopped for a relatively long time, or immediately after the power switch has been turned on, the electrode surface can be wetted reliably with ink and printing can be prevented from starting with the electrode surface being dry. Therefore, with the present invention, the flying characteristic of ink droplets does not change with time and the stable printing operation can be maintained for a long time.

With the present invention, by using a head structure that emits and forces ink droplets to fly vertically from an ink droplet emitting outlet provided as an opening at the auxiliary substrate, the ink can be prevented from flooding and spilling, when a slightly high pressure is applied to the ink to wet the electrode surface, or when an unexpected physical impact is exerted on the ink during operation.

Furthermore, the main electrode array can be formed into a staggered fashion, so that printing with a resolution twice as high as the arrangement pitch of the main electrode array can be realized with an in-line structure.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An ink-jet printer comprising:

holding means having an emitting outlet, for holding ink in which charged coloring material components are floating in solvent;

control means for controlling a concentration of the coloring material components in the ink in the vicinity of the emitting outlet: and printing means for forcing the coloring material components to fly in the form of ink droplets from the emitting outlet as a printing medium when the concentration of the coloring material components is increased in the vicinity of the emitting outlet by said control means and thereby printing a desired image on the printing medium.

2. An ink-jet printer according to claim 1, wherein said control means controls the concentration of the coloring material components by electric force.

3. An ink-jet printer according to claim 2, wherein said holding means includes:

a main substrate to which said ink is supplied; and an auxiliary substrate provided so as to face the main substrate, and said control means includes an auxiliary electrode array that is arranged on the auxiliary substrate and transports the coloring material components in the ink supplied onto the main substrate to the vicinity of said emitting outlet in the printing operation, and keeps the coloring material components away from the vicinity of said emitting outlet in the non-printing operation.

4. An ink-jet printer according to claim 3, wherein said printing means includes:

a main electrode array arranged on the main substrate; and main electrode driving means for supplying a predetermined voltage signal to the main electrode array to force ink droplets to fly from the emitting outlet;

the auxiliary electrode array of said control means is arranged so as to cross said main electrode array at right angles; and said control means includes auxiliary electrode driving means for supplying a voltage signal to said auxiliary electrode array so that the coloring material components in the ink supplied onto said main substrate is transported to the vicinity of the emitting outlet in the printing operation, and the coloring material components is kept away from the vicinity of the emitting outlet in the non-printing operation.

5. An ink-jet printer according to claim 4, wherein the emitting outlet is provided at the auxiliary substrate so that the ink droplets are emitted in the direction perpendicular to the face of the auxiliary substrate.

6. An ink-jet printer according to claim 5, wherein the emitting outlet is provided at the auxiliary substrate to form slits; and the main electrode array is arranged vertically in a staggered form with respect to the emitting outlet.

7. An ink-jet printer according to claim 4, wherein the emitting outlet is provided between the main substrate and the auxiliary substrate so that said ink droplets are emitted in the direction parallel to the faces of the main substrate and the auxiliary substrate.

8. An ink-jet printer according to claim 3, further comprising an exclusive electrode being provided near the emitting outlet and keeps the coloring material components away from the vicinity of the emitting outlet by electric force in the non-printing operation.

9. An ink-jet printer according to claim 3, further comprising a lid to which a voltage is applied in a non-printing operation so that the coloring material components in the ink are kept away from said emitting outlet and which is provided so as to close said emitting outlet.

10. An ink-jet printer according to claim 2, further comprising thickness control means for thinning the thickness of the ink near said emitting outlet in the printing operation and thickening the thickness in the non-printing operation.

11. An ink-jet printer according to claim 10, wherein said thickness control means controls the thickness of the ink near the emitting outlet so that the thickness is 30 $\mu$m or less in the printing operation and is 100 $\mu$m or more in the non-printing operation.

12. An ink-jet printer comprising:

holding means having an emitting outlet, for holding ink in which charged coloring material components are floating in solvent;

thickness control means for controlling a thickness of the ink in a vicinity of the emitting outlet: and printing means for forcing the coloring material components to fly in the form of ink droplets from the emitting outlet at a printing medium when the thickness of the ink is decreased in the vicinity of the emitting outlet by said control means and thereby printing a desired image on the printing medium.

13. An ink-jet printer according to claim 12, wherein said thickness control means controls the thickness of the ink near the emitting outlet so that the film thickness is 30 $\mu$m or less in the printing operation and is 100 $\mu$m or more in the non-printing operation.

* * * * *